US009405249B2

(12) United States Patent
Hirai et al.

(10) Patent No.: US 9,405,249 B2
(45) Date of Patent: Aug. 2, 2016

(54) HEAT-FIXING DEVICE

(71) Applicant: CANON KABUSHIKI KAISHA, Tokyo (JP)

(72) Inventors: Masahide Hirai, Numazu (JP); Munehito Kurata, Boise, ID (US); Shinji Hashiguchi, Mishima (JP); Shizuma Nishimura, Suntou-gun (JP); Michio Uchida, Mishima (JP); Hisahiro Saito, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/802,159

(22) Filed: Jul. 17, 2015

(65) Prior Publication Data

US 2016/0026132 A1 Jan. 28, 2016

(30) Foreign Application Priority Data

Jul. 22, 2014 (JP) ..... 2014-148610

(51) Int. Cl.

*G03G 15/20* (2006.01)
*H05B 6/06* (2006.01)
*H05B 6/14* (2006.01)

(52) U.S. Cl.

CPC ..... *G03G 15/2082* (2013.01); *G03G 15/2053* (2013.01); *H05B 6/06* (2013.01); *H05B 6/145* (2013.01)

(58) Field of Classification Search

CPC . G03G 15/2082; G03G 15/2053; H05B 6/06; H05B 6/10

See application file for complete search history.

(56) References Cited

U.S. PATENT DOCUMENTS 7,177,579 B2 2/2007 Uchida et al.
7,190,914 B2 3/2007 Nihonyanagi et al.

(Continued)

FOREIGN PATENT DOCUMENTS

JP 2000-223253 8/2000
JP 2005-100699 4/2005

(Continued)

OTHER PUBLICATIONS

Shinji Hashiguchi et al., U.S. Appl. No. 14/804,548, filed Jul. 21, 2015.

(Continued)

*Primary Examiner* — Erika J Villaluna
(74) *Attorney, Agent, or Firm* — Fitzpatrick, Cella, Harper & Scinto

(57) ABSTRACT

A fixing device includes: a rotatable member including an electroconductive layer; a helical coil having a helical axis direction along a generatrix direction of the rotatable member; a magnetic member not forming a loop outside the electroconductive layer; a frequency setting portion for setting a frequency of an AC current caused to flow through the coil; and a temperature detecting portion for detecting a temperature of the rotatable member, including a first temperature detecting member and a second temperature detecting member. The electroconductive layer generates heat through electromagnetic induction heating by magnetic flux resulting from the AC current, and an image is fixed on a recording material by heat of the rotatable member. The frequency setting portion sets the frequency depending on a value of a difference between a detection temperature of the first temperature detecting member and a detection temperature of the second temperature detecting member.

9 Claims, 24 Drawing Sheets

(56) References Cited

U.S. PATENT DOCUMENTS

| | | | |
|---|---|---|---|
| 7,215,899 | B2 | 5/2007 | Kimizuka et al. |
| 7,251,447 | B2 | 7/2007 | Kanamori et al. |
| 7,280,775 | B2 | 10/2007 | Kubochi et al. |
| 7,283,780 | B2 | 10/2007 | Uchida et al. |
| 7,321,746 | B2 | 1/2008 | Sakakibara et al. |
| 7,512,370 | B2 | 3/2009 | Shimizu et al. |
| 7,518,089 | B2 | 4/2009 | Hashiguchi et al. |
| 7,865,120 | B2 | 1/2011 | Suzuki et al. |
| 8,068,757 | B2 | 11/2011 | Hashiguchi |
| 8,112,024 | B2 | 2/2012 | Saito et al. |
| 8,265,507 | B2 | 9/2012 | Saito et al. |
| 8,331,819 | B2 | 12/2012 | Fukuzawa et al. |
| 8,472,826 | B2 | 6/2013 | Hashiguchi |
| 8,725,020 | B2 | 5/2014 | Fukuzawa et al. |
| 8,744,296 | B2 | 6/2014 | Fukuzawa et al. |
| RE45,015 | E | 7/2014 | Uchida et al. |
| 8,811,872 | B2 | 8/2014 | Nakagawa et al. |
| 8,811,876 | B2 | 8/2014 | Endo et al. |
| 8,918,001 | B2 | 12/2014 | Kurata et al. |
| 9,091,974 | B2 | 7/2015 | Yoshioka et al. |
| 2014/0161498 | A1 | 6/2014 | Hashiguchi et al. |
| 2015/0168880 | A1 | 6/2015 | Jota et al. |
| 2015/0168889 | A1 | 6/2015 | Kita et al. |
| 2015/0268602 | A1 | 9/2015 | Yoshioka et al. |

FOREIGN PATENT DOCUMENTS

| | | |
|---|---|---|
| JP | 2011-33642 | 2/2011 |
| JP | 2012-234058 | 11/2012 |

OTHER PUBLICATIONS

U.S. Appl. No. 14/804,548, filed Jul. 21, 2015.

(a)

(b)

(a)

(b)

(a)

(b)

(a)

(b)

$$|X| = \frac{1}{\sqrt{\left(\frac{1}{R'}\right)^2 + \left(\frac{1}{\omega M}\right)^2}}$$

(a)

(b)

$$|X_e| = \frac{1}{\sqrt{\left(\frac{1}{6^2R}\right)^2+\left(\frac{1}{\omega M_e}\right)^2}} \qquad |X_c| = \frac{1}{\sqrt{\left(\frac{1}{6^2R}\right)^2+\left(\frac{1}{\omega M_c}\right)^2}}$$

HEAT-FIXING DEVICE

FIELD OF THE INVENTION AND RELATED ART

The present invention relates to a heat-fixing device for heat-fixing, as a fixed image, an unfixed toner image formed and carried on a recording material at an image forming process portion in an image forming apparatus employing an image forming process of an electrophotographic type, an electrostatic recording type or the like. Examples of the recording material include a transfer material, a printing sheet, a photosensitive paper, electrostatic recording paper, and so on.

Conventionally, a fixing device provided in an image forming apparatus, of an electrophotographic type, such as a copying machine, a printer or a facsimile machine heats and melts an unfixed toner image formed on a surface of the recording material, and fixes the toner on the recording material as a member-to-be-heated.

As a method of heating a heating member, it is possible to cite a method of heating the heating member by heat of a heater such as a halogen lamp or a ceramic heater and an electromagnetic induction heating method of generating a current in the heating member by a magnetic field generated by an exciting coil and then by heating the heating member by Joule heat at that time.

In the electromagnetic induction heating method, the heating member itself generates heat, and therefore compared with a method of heating the heating member by externally applying heat to the heating member by the heater, it would be considered that the electromagnetic induction heating method is advantageous in terms of the rate of temperature rise of the heating member and the heat supplying efficiency to the heating member.

FIG. 40 shows an example of the electromagnetic induction heating method disclosed in Japanese Laid-Open Patent Application 2000-223253. In this example, a heating member 20, which is a cylindrical rotatable member is externally fitted loosely around a guiding member 23 for the heating member 20. The guiding member 23 for the heating member 20 holds a magnetic core 21 and an exciting coil 22, which are used as a magnetic field generating means, therein. To the exciting coil 22, an unshown exciting circuit is connected, and generates a high frequency from 20 kHz to 500 kHz by a switching power source. The exiting exciting coil 22 generates AC magnetic flux penetrating through the heating member 20 in a thickness direction by an AC current supplied from the exciting circuit.

The guiding member 23 is provided with a sliding member 24 in a side opposing a pressing roller 30 at a nip N and inside the heating member 20. The pressing roller 30 is rotationally driven, in the counterclockwise direction indicated by an arrow, by a driving means M, so that a rotational force acts on the heating member 20 by a frictional force with an outer surface of the heating member 20.

Control of an output electric power is made by adjusting the drive frequency of a current flowing through the exciting coil. FIG. 39 is a graph showing the relationship between the drive frequency and the output electric power. With an increasing drive frequency, the output electric power gradually decreases. In the case where the temperature of the heating member is lower than a target temperature, by setting the drive frequency at a low value to increase the electric power, so that the heating member temperature is quickly increased up to the neighborhood of the target temperature. On the other hand, in the case where the heating member temperature is the neighborhood of the target temperature, the drive frequency is set at a high value to suppress the electric power, so that a steady state is maintained. Such a method that the electric power is adjusted by controlling the drive frequency is generally used in a system in which the heating member temperature is controlled by the electromagnetic induction heating method.

In the steady state, a recording material P carrying thereon an unfixed toner image T is introduced into a nip N, and then is nipped and fed through the nip N, so that the toner image T is thermally pressed and fixed as a fixed image on the recording material P.

FIG. 38 shows an example of the heating member using the electromagnetic induction heating method having another constitution. In this example, the magnetic core 2 is inserted into the cylindrical heating member 1, which is the rotatable member, in a rotational axis direction X, and the exciting coil 3 is wound around a periphery of the magnetic core 2. Accordingly, in this example, when the AC current is caused to flow through the exciting coil 3, magnetic lines of force are generated with respect to the rotational axis direction X of the heating member 1. By the magnetic lines of force, an induced current flows in a rotational direction of the heating member 1, so that the heating member 1 generates heat by the Joule heat of the indicated current.

In FIG. 38, a high-frequency converter 16 as a magnetic circuit for supplying an AC current to the exiting coil 3 is provided, and electric energy supplying coil portions 3*a*, 3*b* are provided. Further, temperature detecting elements 9, 10, 11 are provided at a longitudinal central portion and longitudinal end portions, respectively, of the heating member 1.

With respect to the electromagnetic induction heating method having the constitution as shown in FIG. 38, the case where a base layer (electroconductive member), of the heating member 1, which generates heat through the electromagnetic induction heating varies in thickness depending on a difference among manufactured individual devices individuals will be considered. For example, in the case where 35 μm is set as a design center of a thickness of the base layer, depending on the difference among individual devices that arises during the manufacturing, the base layer thickness varies in a range of 30-40 μm in some cases. Similarly, in the case where electric resistivity varies depending on the difference among individual devices during manufacturing, it turned out that the longitudinal temperature distribution of the heating member 1 varies. This phenomenon is not observed in the case of the electromagnetic induction heating method described with reference to FIG. 40.

FIG. 35 shows a difference in temperature distribution caused due to a difference in thickness of the base layer of the heating member (fixing sleeve) 1, and FIG. 36 shows a difference in temperature distribution caused due to a difference in electric resistivity. Although this phenomenon will be described later, the longitudinal temperature distribution varies depending on the thickness and the electric resistance (electric resistivity) of the base layer of the heating member 1, and therefore depending on the thickness and the electric resistance of the base layer of the heating member 1, a predetermined longitudinal temperature distribution is not obtained and thus a uniform fixing performance is not obtained with respect to a longitudinal direction in some cases. Ideally, by suppressing variations in thickness and electric resistance itself of the base layer and the heating member 1, it is possible to obtain the predetermined longitudinal temperature distribution, but it is difficult to suppress a manufacturing variation in actuality.

SUMMARY OF THE INVENTION

According to an aspect of the present invention, there is provided a fixing device for fixing an image on a recording material, comprising: a rotatable member including an electroconductive layer; a helical coil provided inside the rotatable member, the helical coil having a helical axis direction along a generatrix direction of the rotatable member; and a magnetic member extending in a helical shaped portion formed by the coil. The magnetic member does not from a loop outside the electroconductive layer. The device also comprises: a frequency setting portion for setting the frequency of an AC current caused to flow through the coil; and a temperature detecting portion for detecting the temperature of the rotatable member, the temperature detecting portion including a first temperature detecting member for detecting the temperature of the rotatable member at a central portion with respect to the generatrix direction and a second temperature detecting member for detecting the temperature of the rotatable member at an end portion with respect to the generatrix direction. The electroconductive layer generates heat through electromagnetic induction heating by the magnetic flux resulting from the AC current, and the image is fixed on the recording material by the heat of the rotatable member. The frequency setting portion sets the frequency depending on a value of the difference between the detection temperature of the first temperature detecting member and the detection temperature of the second temperature detecting member.

According to another aspect of the present invention, there is provided a fixing device for fixing an image on a recording material, comprising: a rotatable member including an electroconductive layer; a helical coil provided inside the rotatable member, the helical coil having a helical axis direction along a generatrix direction of the rotatable member; and a magnetic member extending in a helical shaped portion formed by the coil. The magnetic member does not from a loop outside the electroconductive layer. The device also comprises a frequency setting portion for setting the frequency of an AC current caused to flow through the coil; and a temperature detecting portion for detecting the temperature of the rotatable member, the temperature detecting portion including a first temperature detecting member for detecting the temperature of the rotatable member at a central portion with respect to the generatrix direction and a second temperature detecting member for detecting the temperature of the rotatable member at one end portion with respect to the generatrix direction, and a third temperature detecting member for detecting the temperature of the rotatable member at the other end portion with respect to the generatrix direction. The electroconductive layer generates heat through electromagnetic induction heating by the magnetic flux resulting from the AC current, and the image is fixed on the recording material by the heat of the rotatable member. The frequency setting portion sets the frequency depending on a value of the difference between the detection temperature of the first temperature detecting member and an average temperature between the detection temperature of the second temperature detecting member and the detection temperature of the third temperature detecting member.

According to another aspect of the present invention, there is provided a fixing device for fixing an image on a recording material, comprising: a rotatable member including an electroconductive layer; and a helical coil provided inside the rotatable member. The helical coil has a helical axis direction along a generatrix direction of the rotatable member. The device also comprises a magnetic member inserted into a helical shaped portion formed by the coil. The magnetic member does not from a loop outside the electroconductive layer. The device further comprises: a frequency setting portion for setting a frequency of an AC current caused to flow through the coil; and a temperature distribution detecting portion for detecting the temperature of the rotatable member with respect to a longitudinal direction of the rotatable member. The electroconductive layer generates heat through electromagnetic induction heating by magnetic flux resulting from the AC current, and the image is fixed on the recording material by the heat of the rotatable member. The frequency setting portion sets the frequency depending on the temperature distribution detected by the temperature distribution detecting member.

According to another aspect of the present invention, there is provided a temperature distribution adjusting method of a fixing portion provided in an image forming apparatus. The fixing portion includes a rotatable member including an electroconductive layer, a helical coil provided inside the rotatable member having a helical axis direction along a generatrix direction of the rotatable member, and a non-endless magnetic member provided inside a helical shaped portion formed by the coil. The temperature distribution adjusting method comprises the steps of: passing an AC current through the coil to cause the electroconductive layer to generate heat through electromagnetic induction heating; detecting the temperature of the rotatable member at each of a central portion and an end portion with respect to a generatrix direction of the rotatable member; and determining a frequency of the AC current so that when the value of the difference between the temperature at the central portion and the temperature at the end portion is out of a predetermined range, the value of the frequency is adjusted so the difference falls within the predetermined range.

According to a further aspect of the present invention, there is provided a temperature distribution adjusting method of a fixing portion provided in an image forming apparatus. The fixing portion includes a rotatable member including an electroconductive layer, a helical coil provided inside the rotatable member having a helical axis direction along a generatrix direction of the rotatable member, and a non-endless magnetic member provided inside a helical shaped portion formed by the coil. The temperature distribution adjusting method comprising the steps of: passing an AC current through the coil to cause the electroconductive layer to generate heat through electromagnetic induction heating; detecting a temperature distribution of the rotatable member with respect to a generatrix direction of the rotatable member; and determining a frequency of the AC current so that when the temperature distribution is out of a predetermined range, the frequency is adjusted so that the value of the temperature distribution falls within the predetermined range.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described in detail. However, with respect to materials, shapes and a relative arrangement of constituent elements described in the following embodiments, the scope of the present invention is not intended to be limited thereto unless otherwise specified.

Embodiment 1

General Structure of Image Forming Apparatus

Figure 1:
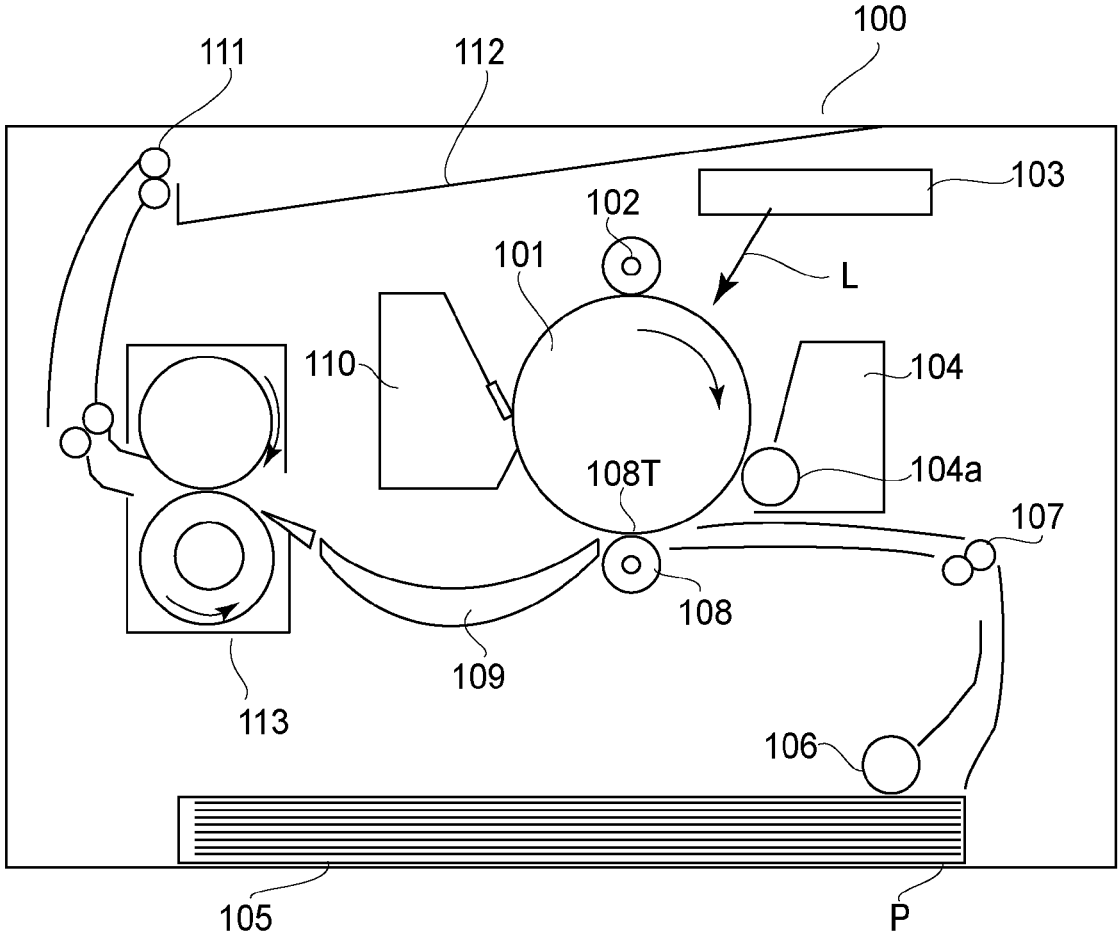
FIG. 1 is a sectional view of an image forming apparatus.

FIG. 1 is a schematic structural view of an image forming apparatus 100 using a fixing device in this embodiment. The image forming apparatus 100 is a laser beam printer of an electrophotographic type.

A photosensitive drum 101 as an image bearing member is rotationally driven in the clockwise direction indicated by an arrow at a predetermined process speed (peripheral speed). In a rotation process of the photosensitive drum 101, the photosensitive drum 101 is electrically charged uniformly to a predetermined polarity and a predetermined potential by a charging roller 102.

A laser beam scanner 103 as an image exposure means outputs laser light L which is ON/OFF-modulated corresponding to a digital pixel signal inputted from an unshown external device, such as a computer, so that a charged surface of the photosensitive drum 101 is subjected to scanning exposure. By this scanning exposure, an electric charge at an exposed light portion of the photosensitive drum surface is removed, so that an electrostatic latent image corresponding to image information is formed on the photosensitive drum surface.

A developing device 104 includes a developing roller **104*a* from which a developer (toner) is supplied to the surface of the photosensitive drum 101, so that the electrostatic latent image on the photosensitive drum surface is successively developed into a toner image that is a visible image. In a feeding cassette 105, sheets of a recording material P are stacked and accommodated. A feeding roller 106 is driven on the basis of a feeding start signal, so that the recording material P in the feeding cassette 105 is separated and fed one by one. Then, the recording material P is introduced at predetermined timing into a transfer portion 108T, which is a contact nip portion between the photosensitive drum 101 and a transfer roller 108 rotated by the photosensitive drum 1 in contact with the photosensitive drum 1, via registration roller pair 107**.

That is, the feeding of the recording material P is controlled by the registration roller pair 107 so that a leading end portion of the toner image on the photosensitive drum 101 and a leading end portion of the recording material P reach the toner portion 108T at the same time. Thereafter, the recording material P is nipped and fed through the transfer portion 108T, and during the feeding, to the transfer roller 108, a transfer voltage (transfer bias) controlled in a predetermined manner is applied from an unshown transfer bias applying power source. Specifically, to the transfer roller 108, the transfer bias of an opposite polarity to the charge polarity of the toner is applied, so that the toner image is electrostatically transferred from the photosensitive drum surface onto the surface of the recording material P at the transfer portion 108T.

The recording material P after the transfer is separated from the photosensitive drum surface and passes through a feeding guide 109, and then is introduced into a fixing device (heat-fixing device) 113 as an image heating apparatus. In the fixing device 113, the toner image is heat-fixed. On the other hand, the photosensitive drum surface after the transfer of the toner image onto the recording material P is subjected to removal of a transfer residual toner, paper powder or the like by a cleaning device 110 to be cleaned, so that the photosensitive drum surface is repetitively subjected to image formation. The recording material P passed through the fixing device 113 is discharged onto a discharge tray 112 through a discharge opening 111.

<Fixing Device>

Figure 2:
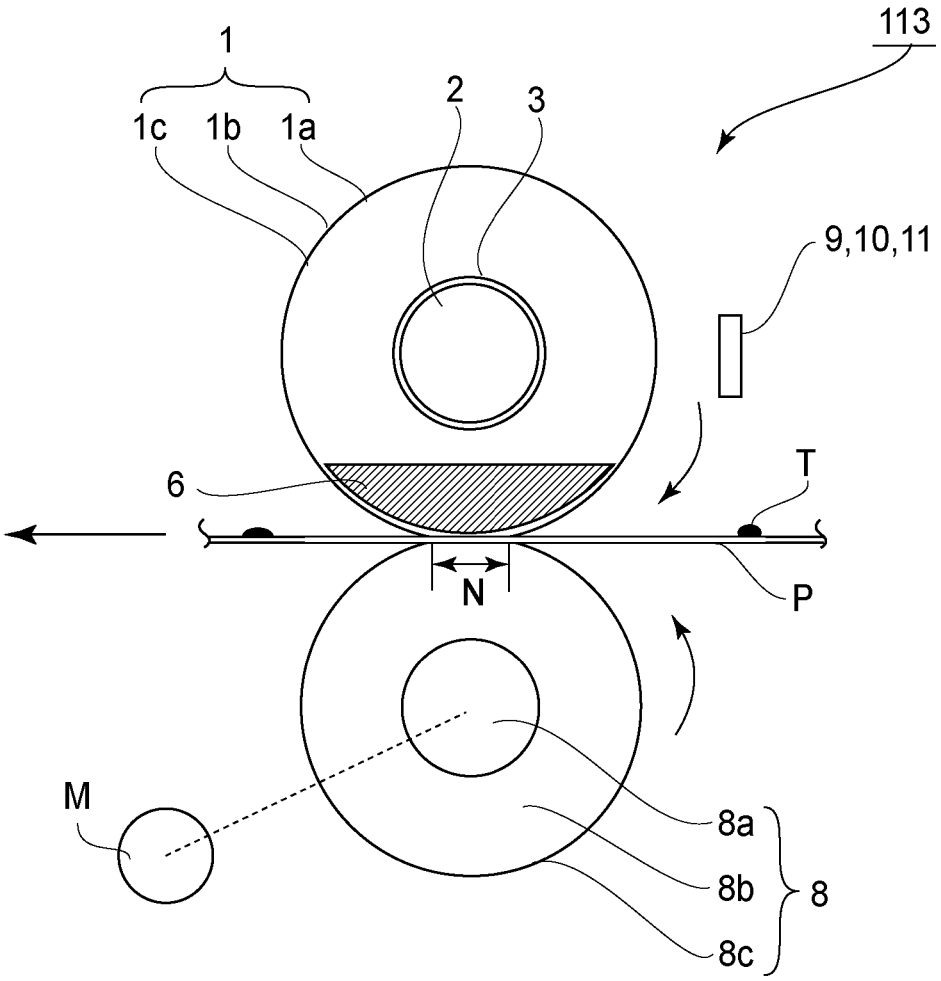
FIG. 2 is a cross-sectional view of a principal part of a fixing device.
Figure 3:
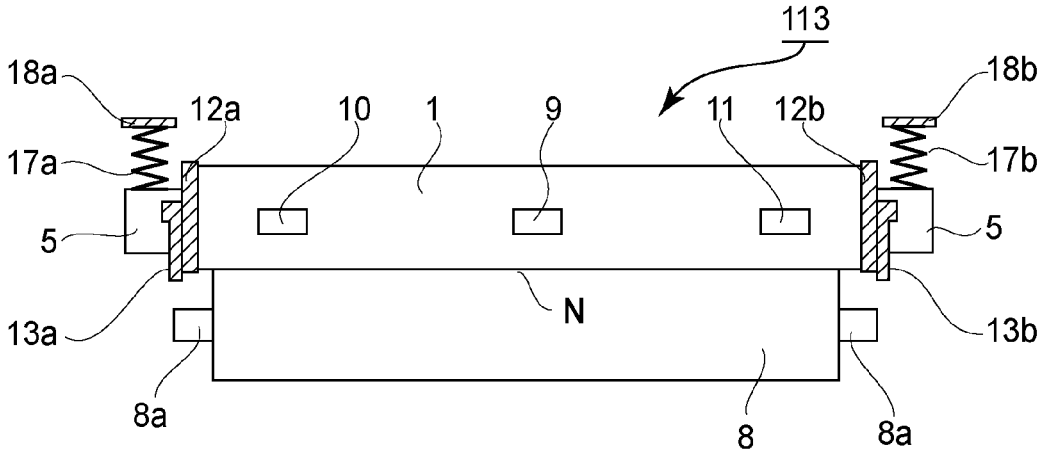
FIG. 3 is a front view of the principal part of the fixing device.
Figure 4:
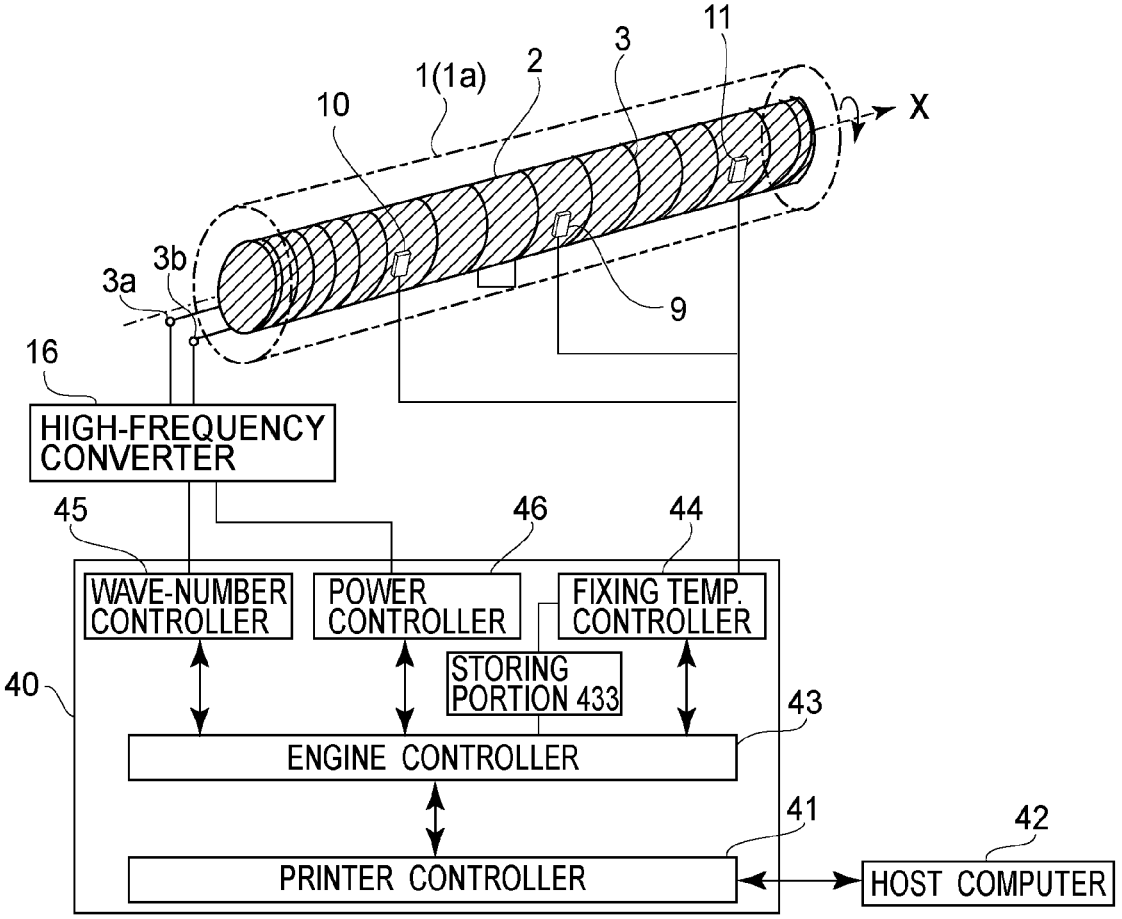
FIG. 4 is a perspective view of the principal part of the fixing device.

In this embodiment, the fixing device 113 is of an electromagnetic induction heating type. FIG. 2 is a cross-sectional view of a principal part of the fixing device 113 in this embodiment, FIG. 3 is a front view of the principal part of the fixing device 113, and FIG. 4 is a perspective view of the principal part of the fixing device 113.

A pressing roller 8 as a rotatable pressing roller 8 is constituted by a metal core 8*a* and a heat-resistant elastic material layer 8*b* which is coated and molded concentratedly integral with the metal core 8*a* in a roller shape and which is formed of a silicone rubber, a fluorine-containing rubber, a fluorine-containing resin material or the like, and a parting layer 8*c* is provided as a surface layer. As a material for the elastic layer 8*b*, a heat-resistant material such as a silicone rubber, a fluorine-containing rubber or a fluoro-silicone rubber is preferred. The metal core 8*a* is rotatably held at end portions thereof between unshown chassis side plates of the fixing device via electroconductive bearings.

Further, between end portions of a pressing stay 5 and spring-receiving members 18*a*, 18*b* (FIG. 3) in a device chassis side, pressing springs 17*a*, 17*b* (FIG. 3) are compressedly provided, respectively, so that a pressing-down force is caused to act on the pressing stay 5. In the fixing device 113 in this embodiment, a pressing force of about 100 N-250 N as a total pressure is applied. As a result, a lower surface of a sleeve guide member formed of heat-resistant PPS or the like and an upper surface of the pressing roller 8 press-contact a cylindrical rotatable member (hereinafter referred to as a fixing sleeve) 1 having an electroconductive layer, so that a fixing nip N having a predetermined width is formed with respect to a recording material feeding direction.

The pressing roller 8 is rotationally driven in the counterclockwise direction indicated by an arrow by a driving means M, so that a rotational force acts on the fixing sleeve 1 by a frictional force with an outer surface of the fixing sleeve 1. Flange members 12*a*, 12*b* are fitted around left and right end portions (one end portion and the other end portion) of the sleeve guide member 6, so that left and right positions thereof are fixed by regulating (limiting) members 13*a*, 13*b*. The flange 12*a*, 12*b* receive the end portions of the fixing sleeve 1 and have the function of limiting movement of the fixing sleeve 1 in a longitudinal direction during rotation of the fixing sleeve 1.

Here, with respect to the fixing device 113, a front side is a side where the recording material P is introduced. Left and right are those when the fixing device 113 is seen from the front side.

As a material for the flanges 12*a*, 12*b*, a heat-resistant material is preferred. For example, it is possible to cite phenolic resin, polyimide resin, polyamide resin, polyamideimide resin, PEEK resin, PES resin, PPS resin, fluorine-containing resin materials (PFA, PTFE, FEP and the like), LCP (liquid crystal polymer), mixtures of these resin materials, and so on.

The fixing sleeve 1 is a cylindrical rotatable member having a composite structure including a base layer 1*a* (electroconductive layer or member which is a metal member of SUS, nickel or iron in this embodiment), an elastic layer 1*b* laminated on an outer surface of the base layer 1*a*, and a parting layer 1*c* laminated on an outer surface of the elastic layer 1*b*. On this base layer 1*a*, an AC magnetic flux whose polarity is reversed periodically by a high-frequency current (AC current) flowing through an exciting coil 3 described later acts, so that a circumferential direction current is generated in the base layer 1*a* and thus the base layer 1*a* generates heat. This heat is conducted to the elastic layer 1*b* and the printing layer 1*c*, so that an entirety of the fixing sleeve 1 is heated to heat the recording material P introduced into the fixing nip N, so that the unfixed toner image T is fixed.

Into a hollow portion insert the fixing sleeve 1, the magnetic core 2 as a magnetic core material (magnetic member) extending in a generatrix direction X (longitudinal direction) of the fixing sleeve 1 is inserted (FIG. 4). Around the magnetic core 2, the exciting coil 3 is wound directly or via a member such as bobbin with respect to a direction crossing the generatrix direction X. FIG. 4 is a perspective view of the fixing sleeve 1 heated by the magnetic core 2 and the exciting coil 3 through electromagnetic induction heating.

The magnetic core 2 is penetrated through the hollow portion of the fixing sleeve 1 and disposed by an unshown fixing means. Then, magnetic lines of force by an AC magnetic field generated by the exciting coil 3 are induced inside the fixing sleeve 1, so that the magnetic core functions as a member for forming a (magnetic) path of the magnetic lines of force. The magnetic core 2 does not form a loop outside the fixing sleeve 1 but forms an open magnetic path in which a part thereof is interrupted.

The exciting coil 3 is formed at the hollow portion of the fixing sleeve by helically winding an ordinary single lead wire around the magnetic core 2. In this way, at the hollow portion of the fixing sleeve 1, the exciting coil 3 is wound in the direction crossing the generatrix direction X of the fixing sleeve 1. For that reason, when an AC current is caused to flow through the exciting coil 3 via a high-frequency converter 16 and electric energy contact portions 3*a*, 3*b*, it is possible to generate a magnetic flux with respect to a direction parallel to the generatrix direction X. A helical axis direction of the exciting coil 3 may only be required to be a direction along the generatrix direction of the fixing sleeve 1.

Temperature detection of the fixing device 113 is, as shown in FIGS. 3 and 4, made by temperature detecting elements 9, 10, 11 which are non-contact thermistors provided in fixing sleeve opposing positions at a central portion and end portions with respect to the longitudinal direction of the fixing sleeve in side where the recording material P is fed to the fixing device 113.

A controller 40 controls the high-frequency converter 16 on the basis of the temperature detected by the temperature detecting element 9 provided at the longitudinal central portion of the fixing sleeve 1. As a result, the fixing sleeve 1 is heated through electromagnetic induction heating, so that the surface temperature thereof is maintained and adjusted to a predetermined target temperature (about 150-200° C.). Further, the temperature detecting elements 10, 11 are provided so as to detect the fixing sleeve surface temperature in positions of 106 mm from a width center of the recording material, with respect to a recording material widthwise direction, fed on a center(-line) basis. By these temperature detecting elements 10, it becomes possible to detect the longitudinal temperature distribution of the fixing sleeve surface.

(1) Heat-Generating Mechanism of Fixing Device in this Embodiment

With reference to (a) of FIG. 5, the heat-generating mechanism of the fixing device in this embodiment will be described specifically.

The magnetic lines of force (indicated by dots) generated by passing the AC current through the exciting coil 3 pass through the inside of the magnetic core 2 inside the cylindrical electroconductive layer 1*a*, which is a base layer of the fixing sleeve 1 in the generatrix direction (a direction from S toward N) of the electroconductive layer 1*a*. Then, the magnetic lines of force move to the outside of the electroconductive layer 1*a* from one end (N) of the magnetic core 2 and return to the other end (S) of the magnetic core 2. As a result, the induced electromotive force for generating magnetic lines of force directed in a direction of preventing an increase and a decrease of magnetic flux penetrating the inside of the electroconductive layer 1*a* in the generatrix direction of the electroconductive layer 1*a* is generated in the heat generating layer 1*a*, so that the current is induced along a circumferential direction of the electroconductive layer 1*a*. By the Joule heat due to this induced current, the electroconductive layer 1*a* generates heat.

The magnitude of the induced electromotive force V generated in the electroconductive layer 1*a* is proportional to a change amount per unit time ($\Delta\phi/\Delta t$) of the magnetic flux passing through the inside of the electroconductive layer 1*a* and the winding number N of the coil is shown in the following formula (500).

$$V=N(\Delta\phi/\Delta t) \quad (500)$$

Figure 5:
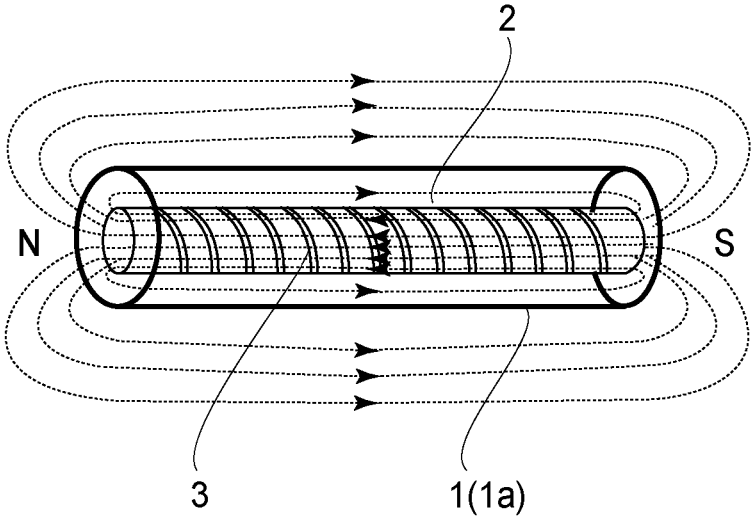
In FIG. 5, (a) and (b) are schematic views each showing magnetic lines of force when a current flows into an exciting coil.
Figure 5:
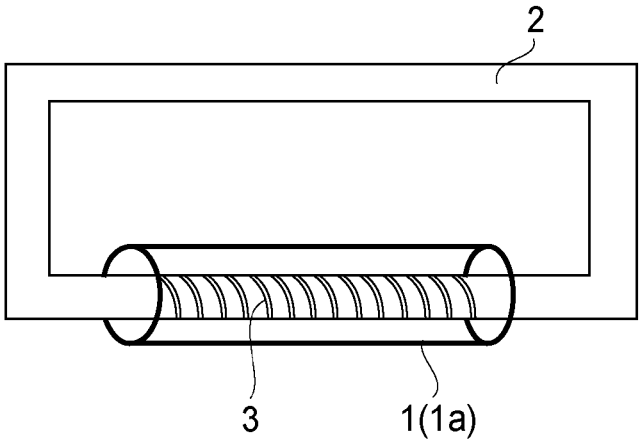

(2) Relationship Between Proportion of Magnetic Flux Passing Through Outside of Electroconductive Layer and Conversion Efficiency of Electric Power The magnetic core 2 in (a) of FIG. 5 does not form a loop and has a shape having end portions. As shown in (b) of FIG. 5, the magnetic lines of force in the fixing device in which the magnetic core 2 forms a loop outside the electroconductive layer 1*a* come out from the inside to the outside of the electroconductive layer 1*a* by being induced in the magnetic core 2 and then return to the inside of the electroconductive layer 1*a*.

However, as shown in (a) of FIG. 5 in this embodiment, in the case of the constitution in which the magnetic core 2 has the end portions, the magnetic lines of force coming out of the end portions of the magnetic core 2 are not induced. For this reason, with respect to a path (from N to S) in which the magnetic lines of force coming out of one end of the magnetic core 2 return to the other end of the magnetic core 2, there is a possibility that the magnetic lines of force pass through both of an outside route in which the magnetic lines of force pass through the outside of the electroconductive layer 1*a* and an inside route in which the magnetic lines of force pass through the inside of the electroconductive layer 1*a*. Hereinafter, a route in which the magnetic lines of force pass through the outside of the electroconductive layer 1*a* from N toward S of the magnetic core 2 is referred to as the outside route, and a route in which the magnetic lines of force pass through the inside of the electroconductive layer 1*a* from N toward S of the magnetic core 2 is referred to as the inside route.

Of the magnetic lines of force coming out of one end of the magnetic core 2, the s-proportion of the magnetic lines of force passing through the outside route correlates with the electric power (conversion efficiency of electric power), consumed by the heat generation of the electroconductive layer 1*a*, of the electric power supplied to the exciting coil 3, and is an important parameter. With an increasing proportion of the magnetic lines of force passing through the outside route, the electric power (conversion efficiency of electric power), consumed by the heat generation of the electroconductive layer 1*a*, of the electric power supplied to the exciting coil 3 becomes higher.

That is, of the magnetic lines of force coming out of one end of the magnetic core 2, when the proportion of the magnetic lines of force passing through the outside of the electroconductive layer 1*a* and returning to the other end of the magnetic core 2 increases, the coupling coefficient increases, so that the conversion efficiency of the electric power becomes higher.

The reason therefor is that the principle thereof is the same as the phenomenon that the conversion efficiency of the electric power becomes high when the leakage flux is sufficiently small in a transformer and the number of magnetic fluxes passing through the inside of primary winding of the transformer and the number of magnetic fluxes passing through the inside of secondary winding of the transformer are equal to each other. That is, in this embodiment, the conversion efficiency of the electric power becomes higher with a closer degree of the numbers of the magnetic fluxes passing through the inside of the magnetic core 2 and the magnetic fluxes passing through the outside route, so that the high-frequency current passing through the exciting coil 3 can be efficiently subjected to, as the circumferential direction current of the electroconductive layer 1*a*, electromagnetic induction.

In (a) of FIG. 5, the magnetic lines of force passing through the inside of the magnetic core 2 from S toward N and the magnetic lines of force passing through the inside route are opposite in direction to each other, and therefore these magnetic lines of force cancel each other as a whole induction the electroconductive layers 1*a* including the magnetic core 2. As a result, the number of magnetic lines of force (magnetic fluxes) passing through the whole of the inside of the electroconductive layer 1*a* form S toward N decreases, so that the change amount per unit time of the magnetic flux becomes small. When the change amount per unit time of the magnetic flux decreases, the induced electromotive force generated in the electroconductive layer 1*a* becomes small, so that the heat generation amount of the electroconductive layer 1*a* becomes small.

As described above, in order to obtain the necessary electric power conversion efficiency by the fixing device 113 in this embodiment, control of the proportion of the magnetic lines of force passing through the outside route is important.

(3) Index Indicating Proportion of Magnetic Flux Passing Through Outside of Electroconductive Layer The proportion passing through the outside route in the fixing device 113 is represented using an index called permeance representing the ease of passing of the magnetic lines of force. First, a general way of thinking about a magnetic circuit will be described. A circuit of a magnetic path along which the magnetic lines of force pass is called the magnetic circuit relative to an electric circuit. When the magnetic flux is calculated in the magnetic circuit, the calculation can be made in accordance with the calculation of the current in the electric circuit. To the magnetic circuit, Ohm's law regarding the electric direction is applicable. When the magnetic flux corresponding to the current in the electric circuit is Φ, a magnetomotive force corresponding to the electromotive force is V, and a magnetic reluctance corresponding to an electrical resistance is R, these parameter satisfy the following formula (501).

$$\Phi = V/R \tag{501}$$

However, for describing the principle in an easy-to-understood manner, a description will be provided made permeance P. When the permeance P is used, the above formula (501) can be represented by the following formula (502).

$$\Phi = V \times P \tag{502}$$

Further, when the length of the magnetic path is B, the cross-sectional area of the magnetic path is S and the permeability of the magnetic path is μ, the permeance P can be represented by the following formula (503).

$$P = \mu \times S/B \tag{503}$$

The permeance P is proportional to the cross-sectional area S and the permeability μ, and is inversely proportional to the magnetic path length B.

Figure 6:
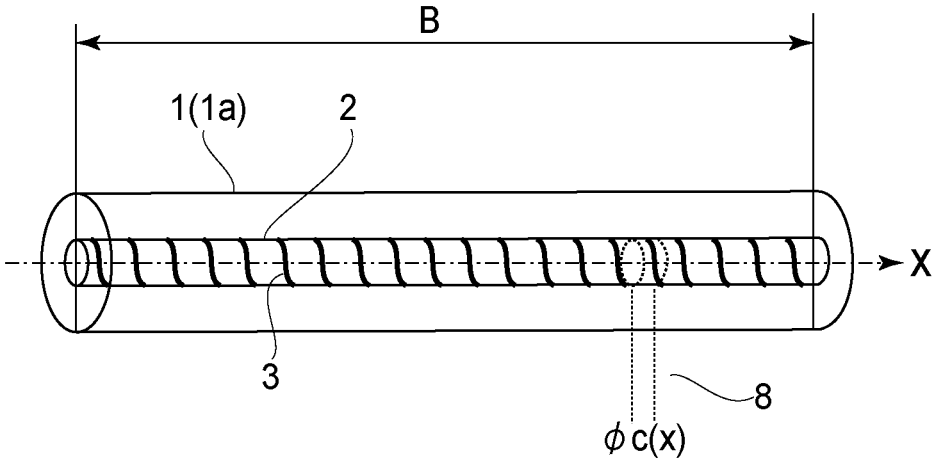
In FIG. 6, (a) and (b) are schematic views each showing a fixing sleeve.
Figure 6:
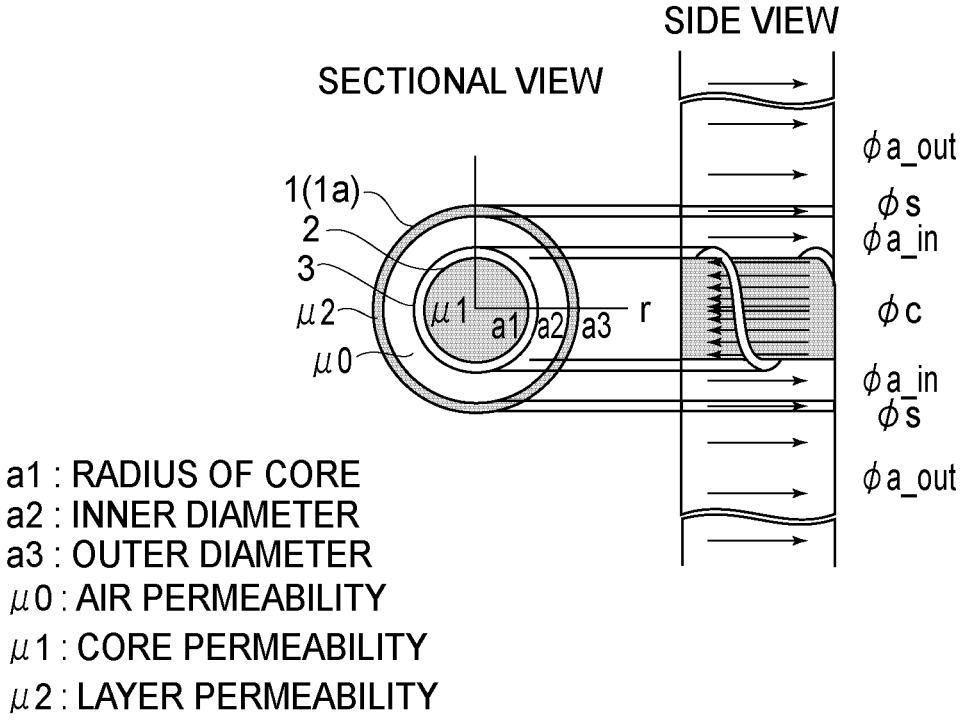

In FIG. 6, (a) is a schematic view showing the coil 3 wound N (times) around the magnetic core 2, of a1 (*m*) in radius, B (m) in length and μ1 in relative permeability, inside the electroconductive layer 1*a* in such a manner that a helical axis of the coil 3 is substantially parallel to the generatrix direction of the electroconductive layer 1*a*. In this case, the electroconductive layer 1*a* is an electroconductor of B (m) in length, a2 (*m*) in inner diameter, a3 (m) in outer diameter and μ2 in relative permeability. The space permeability induction outside the electroconductive layer 1*b* is μ0 (H/m). When a current I (A) is passed through the coil 3, magnetic flux 8 generated per unit length of the magnetic core 2 is ϕc (x).

FIG. 6, (b) is a sectional view perpendicular to the longitudinal direction of the magnetic core 2. Arrows in the figure represent magnetic fluxes, parallel to the longitudinal direction of the magnetic core 2, passing through the inside of the magnetic core 2, the induction of the electroconductive layer 1*a* and the outside of the electroconductive layer 1*a* when the current I is passed through the coil 3. The magnetic flux passing through the inside of the magnetic core 2 is c(=ϕc (x)), the magnetic flux passing through the inside of the electroconductive layer 1*a* (in a region between the electroconductive layer 1*a* and the magnetic core 2) is ϕa_in, the magnetic flux passing through the electroconductive layer itself is ϕs, and the magnetic flux passing through the outside of the electroconductive layer is ϕa_out.

Figure 7:
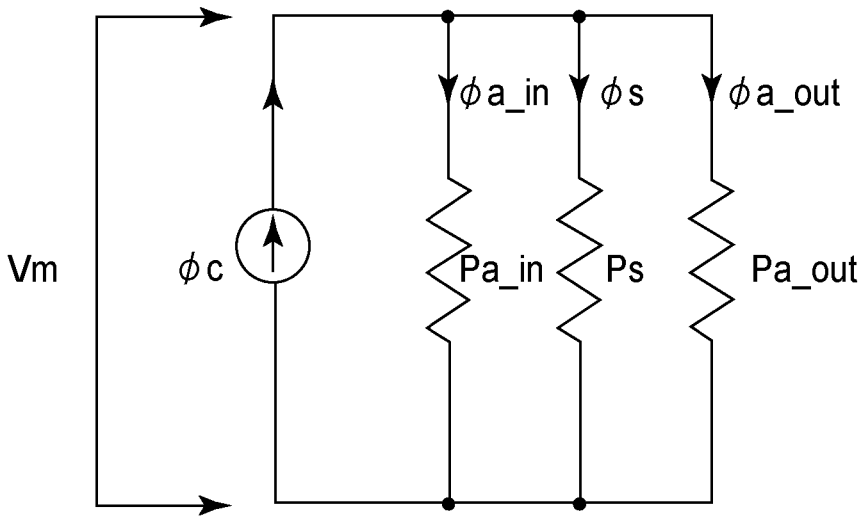
In FIG. 7, (a) and (b) are magnetic equivalent circuits in constitutions shown in FIGS. 5 and 6.
Figure 7:
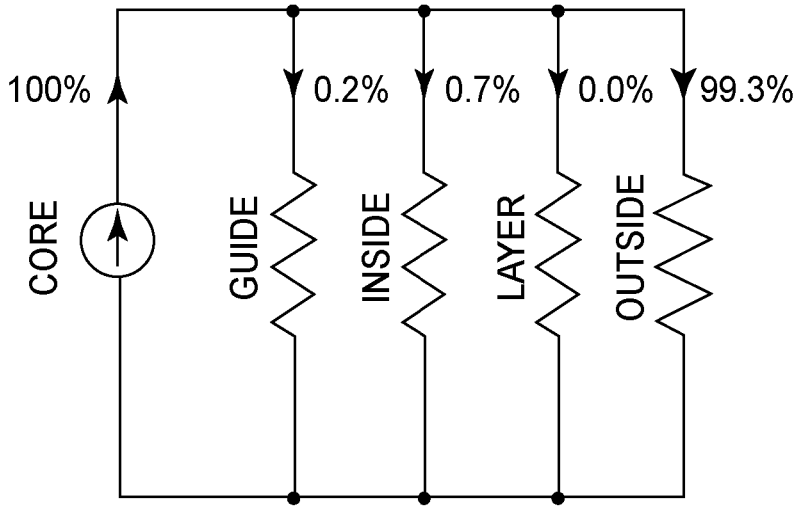

In FIG. 7, (a) shows a magnetic equivalent circuit in a space including the core 2, the coil 3 and the electroconductive layer 1*a* per unit length, which are shown in (a) of FIG. 5. The magnetomotive force generated by the magnetic flux ϕc passing through the magnetic core 2 is Vm, the permeance of the magnetic core 2 is Pc, and the permeance inside the electroconductive layer 1*b* is Pa_in. Further, the permeance in the electroconductive layer 1*a* itself of the sleeve 1 is Ps, and the permeance outside the electroconductive layer 1*a* is Pa_out.

When Pc is large enough compared with Pa_in and Ps, it would be considered that the magnetic flux coming out of one end of the magnetic core 2 after passing through the inside of the magnetic core 2 returns to the other end of the magnetic core 2 after passing through either of ϕa_in, ϕs and ϕa_out. Therefore, the following formula (504) holds.

$$\phi c = \phi a_in + \phi s + \phi a_out \tag{504}$$

Further, ϕc, ϕa_in, ϕs and ϕa_out are represented by the following formulas (505) to (508), respectively.

$$\phi c = Pc \times Vm \tag{505}$$

$$Ps \times Vm \tag{506}$$

$$\phi a_in = Pa_in \times Vm \tag{507}$$

$$\phi a_out = Pa_out \times Vm \tag{508}$$

Therefore, when the formulas (505) to (508) are substituted into the formula (504), Pa_out is represented by the following formula (509).

$$\begin{aligned} Pc \times Vm &= \text{Pa_in} \times Vm + Ps \times Vm + \text{Pa_out} \times Vm \\ &= (\text{Pa_in} + Ps + \text{Pa_out}) \times Vm \\ YUENI\ \text{Pa_out} &= Pc - \text{Pa_in} - Ps \end{aligned} \tag{509}$$

When the cross-sectional area of the magnetic core 2 is Sc, the cross-sectional area inside the electroconductive layer 1*a* is Sa_in and the cross-sectional area of the electroconductive layer 1*a* itself is Ss, each of values of the permeance Pc, Pa_in and Ps can be represented as shown below. The unit is "H·m".

$$Pc = \mu 1 \times Sc = \mu 1 \times \Pi(a1)^2 \tag{510}$$

$$\begin{aligned} \text{Pa_in} &= \mu 0 \times \text{Sa_in} \\ &= \mu 0 \times \Pi \times ((a2)^2 - (a1)^2) \end{aligned} \tag{511}$$

$$Ps = \mu 2 \times Ss = \mu 2 \times \Pi \times ((a3)^2 - (a2)^2) \tag{512}$$

When the formulas (510) to (512) are substituted into the formula (509), Pa_out is represented by the following formula (513).

$$\begin{aligned} \text{Pa_out} &= Pc - \text{Pa_in} - Ps \\ &= \mu 1 \times Sc - \mu 0 \times \text{Sa_in} - \mu 2 \times Ss \\ &= \Pi \times \mu 1 \times (a1)^2 - \\ &\quad \Pi \times \mu 0 \times ((a2)^2 - (a1)^2) - \\ &\quad \Pi \times \mu 2 \times ((a3)^2 - (a2)^2) \end{aligned} \tag{513}$$

By using the above formula (513), Pa_out/Pc, which is a proportion of the magnetic lines of force passing through the outside of the electroconductive layer 1*a*, can be calculated.

In place of the permeance P, the magnetic reluctance R may also be used. In the case where the magnetic reluctance R is used, the magnetic reluctance R is simply the reciprocal of the member P, and therefore the magnetic reluctance R per unit length can be expressed by "1/((permeability)×(cross-sectional area)), and the unit is "1/(H·m)".

A result of specific calculation using parameters of the fixing device A in this embodiment is shown in Table 1.

TABLE 1

| Item | U*1 | MC*2 | FG*3 | IEL*4 | EL*5 | OEL*6 |
|---|---|---|---|---|---|---|
| CSA*7 | $m^2$ | 1.5E−04 | 1.0E−04 | 2.0E−04 | 1.5E−06 | |
| RP*8 | | 1800 | 1 | 1 | 1 | |
| P*9 | H/m | 2.3E−03 | 1.3E−06 | 1.3E−06 | 1.3E−06 | |
| PUL*10 | H · m | 3.5E−07 | 1.3E−10 | 2.5E−10 | 1.9E−12 | 3.5E−07 |
| MRUL*11 | 1/(H · m) | 2.9E+06 | 8.0E+09 | 4.0E+09 | 5.3E+11 | 2.9E+06 |
| MFR*12 | % | 100.0 | 0.0 | 0.1 | 0.0 | 99.9 |

*1."U" is the unit.
*2."MC" is the magnetic core.
*3."FG" is the film guide.
*4."IEL" is the inside of the electroconductive layer.
*5."EL" is the electroconductive layer.
*6."OEL" is the outside of the electroconductive layer.
*7."CSA" is the cross-sectional area.
*8."RP" is the relative permeability.
*9."P" is the permeability.
*10."PUL" is the permeance per unit length.
*11."MRUL" is the magnetic reluctance per unit length.
*12."MFR" is the magnetic flux ratio.

The magnetic core 2 is formed of ferrite (relative permeability: 1800) and is 14 (mm) in diameter and $1.5\times10^{-4}$ ($m^2$) in cross-sectional area. The sleeve guide 6 is formed of PPS (polyphenylene sulfide) (relative permeability: 1.0) and is $1.0\times10^{-4}$ ($m^2$) in cross-sectional area. The electroconductive layer 1*a* is formed of aluminum (relative permeability: 1.0) and is 24 (mm) in diameter, 20 (μm) in thickness and $1.5\times10^{-6}$ ($m^2$) in cross-sectional area.

The cross-sectional area of the region between the electroconductive layer 1*a* and the magnetic core 2 is calculated by subtracting the cross-sectional area of the magnetic core 2 and the cross-sectional area of the sleeve guide 6 from the cross-sectional area of the hollow portion inside the electroconductive layer 1*a* of 24 mm in diameter. The elastic layer 1*b* and the surface layer 1*c* are provided outside the electroconductive layer 1*a* and do not contribute to the heat generation. Accordingly, in a magnetic circuit model for calculating the permeance, the layers 1*b* and 1*c* can be regarded as air layers outside the electroconductive layer 21*a*, and therefore, there is no need to add the layers into the calculation.

From Table 1, Pc, Pa_in and Ps are values shown below.

$$Pc=3.5\times10^{-7}(H\cdot m)$$

$$Pa_\text{in}=1.3\times10^{-10}+2.5\times10^{-10}(H\cdot m)$$

$$Ps=1.9\times10^{-12}(H\cdot m)$$

From a formula (514) shown below, Pa_out/Pc can be calculated using these values.

$$Pa_\text{out}/Pc=(Pc-Pa_\text{in}-Ps)/Ps=0.999(99.9\%) \tag{514}$$

The magnetic core 2 is divided into a plurality of cores with respect to the longitudinal direction, and a spacing (gap) is provided between adjacent divided cores in some cases. In the case where this spacing is filled with the air or a material whose relative permeability can be regarded as 1.0 or whose relative permeability is considerably smaller than the relative permeability of the magnetic core 2, the magnetic reluctance R of the magnetic core 2 as a whole becomes large, so that the function of inducing the magnetic lines of force degrades.

The calculating method of the permeance of the magnetic core 2 divided in the plurality of cores described above becomes complicated. In the following, a calculating method of the permeance of a whole of the magnetic core 2 in the case where the magnetic core 2 is divided into the plurality of cores which are equidistantly arranged via the spacing or the sheet-like non-magnetic material will be described. In this case, the magnetic reluctance over a longitudinal full length is derived and then is divided by the longitudinal full length to obtain the magnetic reluctance per unit length, and thereafter there is a need to obtain the permeance per unit length using the reciprocal of the magnetic reluctance per unit length.

Figure 8:
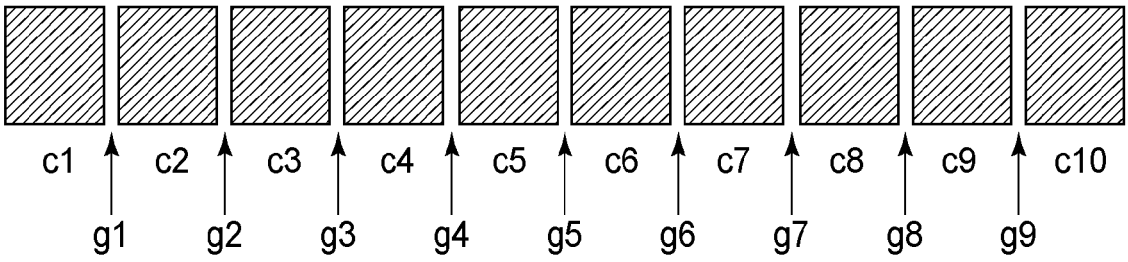
FIG. 8 is a schematic view of magnetic cores with respect to a longitudinal direction.

First, a schematic view of the magnetic core 2 with respect to the longitudinal direction is shown in FIG. 8. Each of magnetic cores c1 to c10 is Sc in cross-sectional area, μc in permeability and Lc in width, and each of gaps g1 to g9 is Sg in cross-sectional area, μg in permeability and Lg in width. The total magnetic reluctance Rm_all of these magnetic cores with respect to the longitudinal direction is given by the following formula (515).

$$Rm_\text{all}=(Rm_c1+Rm_c2+\ldots+Rm_c10)+(Rm_g1+Rm_g2+\ldots+Rm_g9) \tag{515}$$

In this case, the shape, the material and the gap width of the respective magnetic cores are uniform, and therefore when the sum of values of Rm_c is ΣRm_c, and the sum of values of Rm_g is ΣRm_g, the respective magnetic reluctances can be represented by the following formulas (516) to (518).

$$Rm_\text{all}=(\Sigma Rm_c)+(\Sigma Rm_g) \tag{516}$$

$$Rm_c=Lc/(\mu c\times Sc) \tag{517}$$

$$Rm_g=Lg/(\mu g\times Sg) \tag{518}$$

By substituting the formulas (517) and (518) into the formula (516), the magnetic reluctance Rm_all over the longitudinal full length can be represented by the following formula (519).

$$\begin{aligned}\text{Rm_all} &= (\Sigma\text{Rm_c})+(\Sigma\text{Rm_g})\\ &= (Lc/(\mu c\times Sc))\times10+(Lg/(\mu g\times Sg))\times9\end{aligned} \tag{519}$$

When the sum of values of Lc is ΣLc and the sum of values of Lg is ΣLg, the magnetic reluctance Rm per unit length is represented by the following formula (520).

$$\begin{aligned}Rm &= \text{Rm_all}/(\Sigma Lc+\Sigma Lg)\\ &= \text{Rm_all}/(Lc\times10+Lg\times9)\end{aligned} \tag{520}$$

From the above, the permeance Pm per unit length is obtained from the following formula (521).

$$Pm = 1/Rm \quad (521)$$
$$= (\Sigma Lc + \Sigma Lg)/\mathrm{Rm_all}$$
$$= (\Sigma Lc + \Sigma Lg)/[\{\Sigma Lc/(\mu c + Sc)\} + \{\Sigma Lg/(\mu g + Sg)\}]$$

An increase in gap Lg leads to an increase in magnetic reluctance (i.e., a lowering in permeance) of the magnetic core 2. When the fixing device 110 in this embodiment is constituted, on a heat generation principle, it is desirable that the magnetic core 2 is designed so as to have a small magnetic reluctance (i.e., a large permeance), and therefore it is not so desirable that the gap is provided. However, in order to prevent breakage of the magnetic core 2, the gap is provided by dividing the magnetic core 2 into a plurality of cores in some cases.

As described above, the proportion of the magnetic lines of force passing through the outside route can be represented using the permeance or the magnetic reluctance.

(4) Conversion Efficiency of Electric Power Necessary for Fixing Device

Next, the conversion efficiency of the electric power necessary for the fixing device in this embodiment will be described. For example, in the case where the conversion efficiency of the electric power is 80%, the remaining 20% of the electric power is converted into thermal energy by the coil, the core and the like, other than the electroconductive layer, and then is consumed. In the case where the electric power conversion efficiency is low, members, which should not generate heat, such as the magnetic core and the coil generate heat, so that there is a need to take measures to cool the members in some cases.

Figure 9:
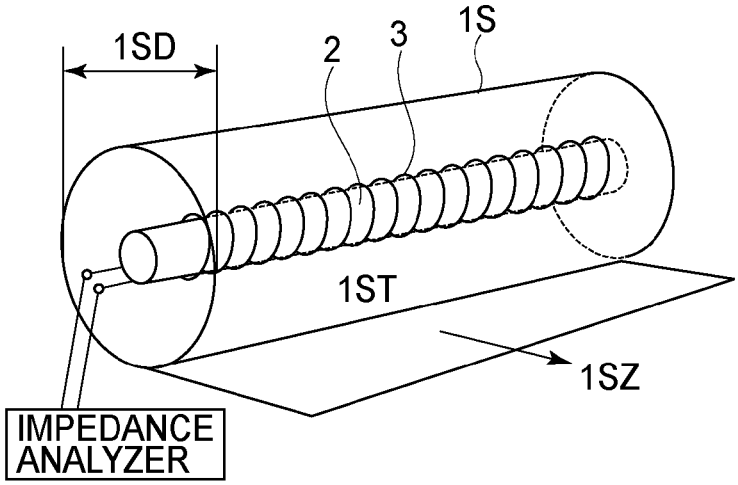
FIG. 9 is a schematic view of an experimental device for measuring electric power conversion efficiency.

Therefore the electric power conversion efficiency is evaluated by changing the proportion of the magnetic flux passing through the outside route of the electroconductive layer 1*a*. FIG. 9 is a schematic view showing an experimental device used in a measurement test of the electric power conversion efficiency. A metal sheet 1S is an aluminum-made sheet of 230 mm in width, 600 mm in length and 20 μm in thickness. This metal sheet 1S is rolled up in a cylindrical shape so as to enclose the magnetic core 2 and the coil 3, and is electrically conducted at a portion 1ST to prepare an electroconductive layer.

The magnetic core 2 is ferrite of 1800 in relative permeability and 500 mT in saturation flux density, and has a cylindrical shape of 26 $mm^2$ in cross-sectional area and 230 mm in length. The magnetic core 2 is disposed substantially at a central (axis) portion of the cylinder of the aluminum sheet 1S by an unshown fixing means. Around the magnetic core 2, the exciting coil 3 is helically wound 25 times in winding number.

When an end portion of the metal sheet 1S is pulled in an arrow 1SZ direction, the diameter 1SD of the electroconductive layer can be adjusted in a range of 18 mm to 191 mm.

Figure 10:
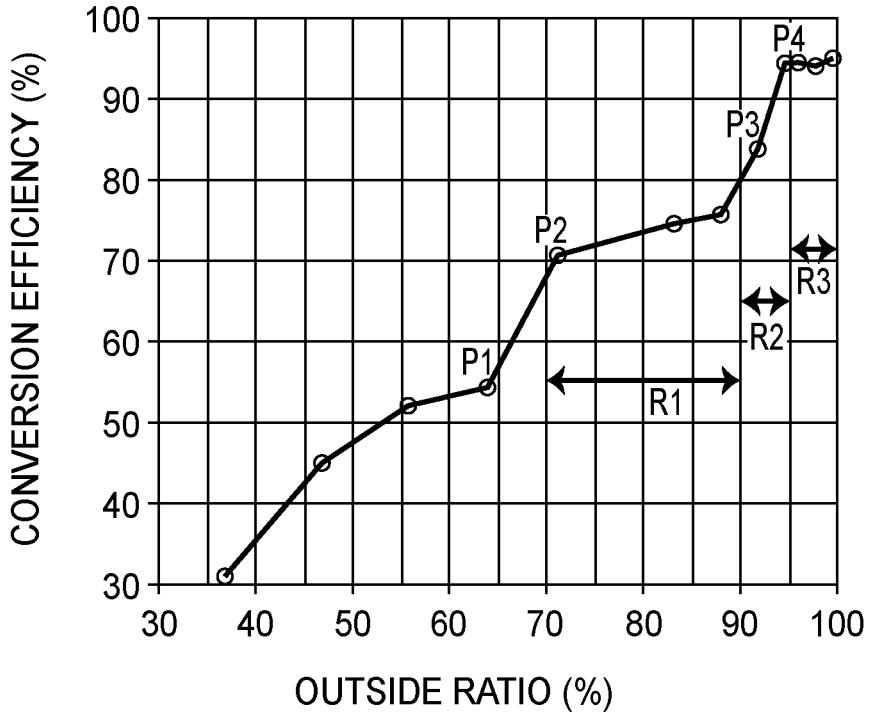
FIG. 10 is a graph for illustrating the electric power conversion efficiency.

FIG. 10 is a graph in which the abscissa represents the ratio (%) of the magnetic flux passing through the outside route of the electroconductive layer, and the ordinate represents the electric power conversion efficiency (%) at a frequency of 21 kHz. In the graph of FIG. 10, the electric power conversion efficiency abruptly increases from a plot P1 and then exceeds 70%, and is maintained at 70% or more in a range R1 indicated by a double-pointed arrow. In the neighborhood of P3, the electric power conversion efficiency abruptly increases again and exceeds 80% in a range R2. In a range R3 from P4, the electric power conversion efficiency is stable at a high value of 94% or more. The reason why the electric power conversion efficiency abruptly increases is that the control direction current starts to pass through the electroconductive layer efficiently.

Table 2 below shows a result of evaluation of constitutions, corresponding to P1 to P4 in FIG. 42, actually designed as fixing devices.

TABLE 2

| Plot | Range | D*1 (mm) | P*2 (%) | CE*3 (%) | ER*4 |
|---|---|---|---|---|---|
| P1 | — | 143.2 | 64.0 | 54.4 | IEP*5 |
| P2 | R1 | 127.3 | 71.2 | 70.8 | CM*6 |
| P3 | R2 | 63.7 | 91.7 | 83.9 | HRD*7 |
| P4 | R3 | 47.7 | 94.7 | 94.7 | OPTIMUM*8 |

*1"D" represents the electroconductive layer diameter.
*2"p" represents the proportion of the magnetic flux passing through the outside route of the electroconductive layer.
*3"CE" represents the electric power conversion efficiency.
*4"ER" represents an evaluation result in the case where the fixing device has a high specification.
*5"IEP" is that there is a possibility that the electric power becomes insufficient.
*6"CM" is that it is desirable that a cooling means is provided.
*7"HRD" is that it is desirable that heat-resistant design is optimized.
*8"OPTIMUM" is that the constitution is optimum for the flexible film.

(Fixing Device P1)

In this constitution, the cross-sectional area of the magnetic core is 26.5 $mm^2$ (5.75 mm×4.5 mm), the diameter of the electroconductive layer is 143.2 mm, and the proportion of the magnetic flux passing through the outside route is 64%. The electric power conversion efficiency, of this device, obtained by the impedance analyzer (FIG. 9) was 54.4%. The electric power conversion efficiency is a parameter indicating the degree (proportion) of electric power contributing to heat generation of the electroconductive layer, of the electric power supplied to the fixing device. Another component is loss, and the loss results in heat generation of the coil and the magnetic core.

In the case of this constitution, during a rise in temperature, the coil temperature exceeds 200° C. in some cases even when 900 W is supplied to the heat generating layer only for several seconds. When it is taken into consideration that the heat-resistant temperature of an insulating member of the coil 3 is high, e.g., 200° C. and that the Curie point of the ferrite magnetic core 2 is about 200° C. to about 250° C. in general at the loss of 45%, it becomes difficult to maintain the member such as the exciting coil at the heat-resistant temperature or less. Further, when the temperature of the magnetic core 2 exceeds the Curie point, the inductance of the coil 3 abruptly decreases, so that the load fluctuates.

About 45% of the electric power supplied to the fixing device is not used for heat generation of the electroconductive layer, and therefore in order to supply the electric power of 900 W to the electroconductive layer, there is a need to supply electric power of about 1636 W. This means that the power source is such that 16.3 A is consumed when 100 V is inputted. Therefore, there is a possibility that the consumed current exceeds the allowable current capable of being supplied from an attachment plug of a commercial AC power source. Accordingly, in the fixing device P1 of 54.4% in electric power conversion efficiency, there is a possibility that the electric power to be supplied to the fixing device is insufficient.

In this constitution, the cross-sectional area of the magnetic core 2 is the same as the cross-sectional area in P1, the diameter of the electroconductive layer is 127.3 mm, and the proportion of the magnetic flux passing through the outside route is 71.2%. The electric power conversion efficiency, of this device, obtained by the impedance analyzer was 70.8%. In some cases, temperature rise of the coil 3 and the core 2 becomes problematic depending on the specification of the fixing device.

When the fixing device of this constitution is constituted as a device having high specifications such that the printing operation is of 60 sheets/min, and the rotational speed of the electroconductive layer is 330 mm/sec, so that there is a need to maintain the temperature of the electroconductive layer at 180° C. When the temperature of the electroconductive layer is intended to be maintained at 180° C., the temperature of the magnetic core 2 exceeds 240° C. in 20 sec in some cases.

The Curie temperature (point) of ferrite used as the magnetic core 2 is ordinarily about 200° C. to about 250° C., and therefore in some cases, the temperature of ferrite exceeds the Curie temperature and the permeability of the magnetic core 2 abruptly decreases, and thus the magnetic lines of force cannot be properly induced by the magnetic core 2. As a result, it becomes difficult to induce the circumferential direction current to cause the electroconductive layer to generate heat in some cases.

Accordingly, when the fixing device, in which the proportion of the magnetic flux passing through the outside route is in the range R1, is constituted as the above-described high-specification device, in order to lower the temperature of the ferrite core 2, it is desirable that a cooling means is provided. As the cooling means, it is possible to use an air-cooling fan, water cooling, a cooling wheel, a radiation fin, heat pipe, Peltier element or the like. In this constitution, there is no need to provide the cooling means in the case where high specifications are is not required to such extent.

(Fixing Device P3)

This constitution is the case where the cross-sectional area of the magnetic core 2 is the same as the cross-sectional area in P1, and the diameter of the electroconductive layer is 63.7 mm. The electric power conversion efficiency, of this device, obtained by the impedance analyzer, was 83.9%. Although the heat quantity is steadily generated in the magnetic core 2, the coil 3 and the like, the level thereof is not a level such that the cooling means is required.

When the fixing device of this constitution is constituted as a device having a high specifications, the printing operation is 60 sheets/min, and the rotational speed of the electroconductive layer is 330 mm/sec. Although there is a need to maintain the surface temperature of the electroconductive layer at 180° C., the temperature of the magnetic core (ferrite) does not increase to 220° C. or more. Accordingly, in this constitution, in the case where the fixing device is constituted as the above-described high-specification device, it is desirable that ferrite having the Curie temperature of 220° C. or more is used.

As described above, in the case where the fixing device, in which the proportion of the magnetic flux passing through the outside route is in the range R2, is used as the high-specification device, it is desirable that the heat-resistant design of ferrite or the like is optimized. On the other hand, in the case where the high specification is not required as the fixing device, such a heat-resistant design is not needed.

(Fixing Device P4)

This constitution is the case where the cross-sectional area of the magnetic core is the same as the cross-sectional area in P1, and the diameter of the cylindrical member is 47.7 mm. The electric power conversion efficiency, of this device, obtained by the impedance analyzer was 94.7%.

When the fixing device of this constitution is constituted as a device having a high specifications such that the printing operation is 60 sheets/min, (rotational speed of electroconductive layer: 330 mm/sec), even in the case where the surface temperature of the electroconductive layer is maintained at 180° C., the temperatures of the exciting coil 3, the magnetic core 2 and the like do not reach 180° C. or more. Accordingly, the cooling means for cooling the magnetic core, the coil and the like, and particular heat-resistant design are not needed.

As described above, in the range R3 in which the proportion of the magnetic flux passing through the outside route is 94.7% or more, the electric power conversion efficiency is 94.7% or more, and thus is sufficiently high. Therefore, even when the fixing device of this constitution is used as a further high-specification fixing device, the cooling means is not needed.

Further, in the range R3 in which the electric power conversion efficiency is stable at high values, even when the amount of the magnetic flux, per unit time, passing through the inside of the electroconductive layer somewhat fluctuates depending on a fluctuation in positional relationship between the electroconductive layer and the magnetic core 2, the fluctuation amount of the electric power conversion efficiency is small, and therefore the heat generation amount of the electroconductive layer is stabilized. As in the case of the fixing sleeve, in the fixing device in which the distance between the electroconductive layer and the magnetic core 2 is liable to fluctuate, the use of the range R3 in which the electric power conversion efficiency is stable at the high values has a significant advantage.

As described above, it is understood that in the fixing device 113 in this embodiment, there is a need that the proportion of the magnetic flux passing through the outside route is 72% or more in order to satisfy at least the necessary electric power conversion. In Table 2, the numerical values are 71.2% or more, but in view of a measurement error or the like, the magnetic flux proportion is 72%.

(5) Relational Expression of Permeance or Magnetic Reluctance to be Satisfied by Fixing Device The requirement that the proportion of the magnetic flux passing through the outside route of the electroconductive layer 1*a* is 72% or more is equivalent to the requirement that the sum of the permeance of the electroconductive layer 1*a* and the permeance of the induction (region between the electroconductive layer 1*a* and the magnetic core 2) of the electroconductive layer 1*a* is 28% or less of the permeance of the magnetic core.

That is, with respect to the generatrix direction of the fixing sleeve 1, in a section from one end to the other end of the maximum passing region width of the image on the recording material, the magnetic reluctance of the magnetic core 2 is 28% or less of a combined magnetic reluctance of the magnetic reluctance of the electroconductive layer 1*a* and the magnetic reluctance in a region between the electroconductive layer 1*a* and the magnetic core 2.

Accordingly, one of features of the constitution in this embodiment is that when the permeance of the magnetic core 2 is Pc, the permeance of the inside of the electroconductive layer 1*a* is Pa, and the permeance of the electroconductive layer is Ps, the following formula (522) is satisfied.

$$0.28 \times Pc \geq Ps + Pa \tag{522}$$

When the relational expression of the permeance is replaced with a relational expression of the magnetic reluctance, the following formula (523) is satisfied.

$$0.28 \times P_c \geq P_s + P_a \tag{523}$$

-continued $$0.28\times\frac{1}{R_c}\geq\frac{1}{R_s}+\frac{1}{R_a}$$

$$0.28\times\frac{1}{R_c}\geq\frac{1}{R_{sa}}$$

$$0.28\times R_{sa}\geq Rc$$

However, a combined magnetic reluctance Rsa of Rs and Ra is calculated by the following formula (524).

$$\frac{1}{R_{sa}}=\frac{1}{R_s}+\frac{1}{R_a} \tag{524}$$

$$R_{sa}=\frac{R_a\times R_s}{R_a+R_s}$$

The above-described relational expression of the permeance or the magnetic reluctance may desirably be satisfied, in a cross-section perpendicular to the generatrix direction of the cylindrical rotatable member, over a whole of a maximum recording material reading region of the fixing device.

Similarly, in the fixing device in this embodiment, the proportion of the magnetic flux passing through the outside route is 92% or more in the range R2.

In Table 2, the numerical values are 91.7% or more, but in view of a measurement error or the like, the magnetic flux proportion is 92%. The requirement that the proportion of the magnetic flux passing through the outside route of the electroconductive layer 1*a* is 92% or more is equivalent to the requirement that the sum of the permeance of the electroconductive layer and the permeance of the induction (region between the electroconductive layer 1*a* and the magnetic core 2) of the electroconductive layer 1*a* is 8% or less of the permeance of the magnetic core.

Accordingly, the relational expression of the permeance is represented by the following formula (525).

$$0.08\times Pc\geq Ps+Pa \tag{525}$$

When the relational expression of the permeance is converted into a relational expression of the magnetic reluctance, the following formula (526) is satisfied.

$$0.08\times P_C\geq P_s+P_a$$

$$0.08\times R_{sa}\geq Rc \tag{526}$$

Further, in the fixing device in this embodiment, the proportion of the magnetic flux passing through the outside route is 95% or more in the range R3. In Table 2, an accurate value of the magnetic flux proportion is 94.7%, but in view of a measurement error or the like, the magnetic flux proportion is 95%. The requirement that the proportion of the magnetic flux passing through the outside route of the electroconductive layer 1*a* is 95% or more is equivalent to that the sum of the permeance of the electroconductive layer 1*a* and the permeance of the induction (region between the electroconductive layer 1*a* and the magnetic core 2) of the electroconductive layer 1*a* is 5% or less of the permeance of the magnetic core.

Accordingly, the relational expression of the permeance is represented by the following formula (527).

$$0.05\times Pc\geq Ps+Pa \tag{527}$$

When the relational expression of the permeance is converted into a relational expression of the magnetic reluctance, the following formula (528) is satisfied.

$$0.05\times P_C\geq P_s+P_a$$

$$0.05\times R_{sa}\geq Rc \tag{528}$$

In the above, the relational expressions of the permeance and the magnetic reluctance in the fixing device in which the member or the like in the maximum image region of the fixing device has a uniform cross-sectional structure were shown.

Then, the fixing device, in which the member or the like constituting the fixing device has a non-uniform cross-sectional structure with respect to the longitudinal direction will be described.

Figure 11:
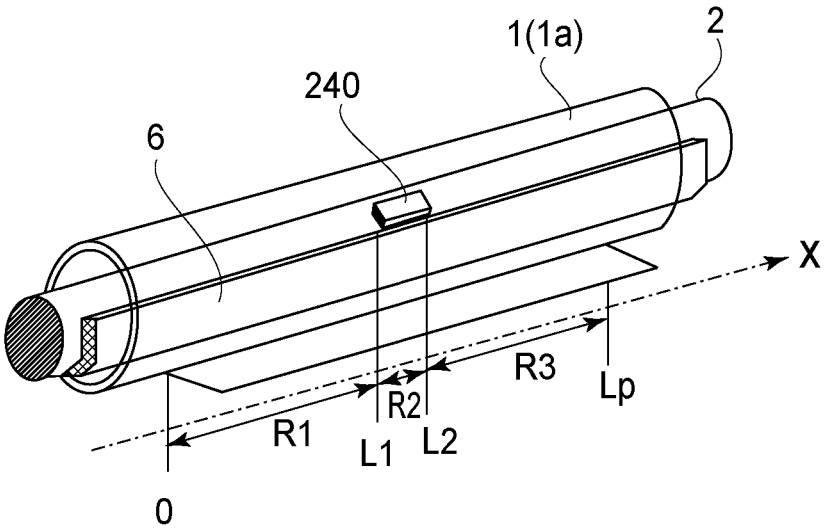
FIG. 11 is a schematic view for illustrating the case of a non-uniform cross-sectional structure with respect to a longitudinal direction.

In FIG. 11, a temperature detecting element 240 is provided inside (region between the magnetic core and the electroconductive layer) of the electroconductive layer 1*a*. Other constitutions are the same as those in the above embodiment, so that the fixing device includes the fixing sleeve 1 including the electroconductive layer 1*a*, and includes the magnetic core 2 and the nip forming member (sleeve guide) 6.

When the longitudinal direction of the magnetic core 2 is an X-axis direction, the maximum image forming region is a range from 0 to Lp on the X-axis. For example, in the case of the image forming apparatus in which the maximum feeding region of the recording material P is the LTR size of 215.9 mm, Lp is 215.9 mm may only be satisfied. The temperature detecting element 240 is constituted by a non-magnetic material of 1 in relative permeability, and is 5 mm×5 mm in cross-sectional area with respect to a direction perpendicular to the X-axis and 10 mm in length with respect to a direction parallel to the X-axis. The temperature detecting member element 240 is disposed at position from L1 (102.95 mm) to L2 (112.95 mm) on the X-axis.

Figure 12:
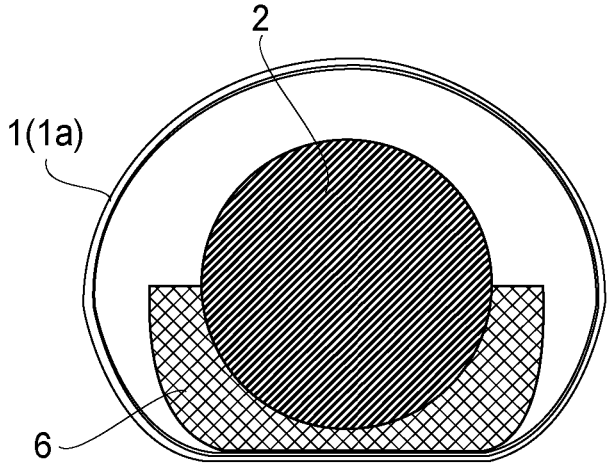
In FIG. 12, (a) and (b) are schematic views each for illustrating the case of the non-uniform cross-sectional structure with respect to the longitudinal direction.
Figure 12:
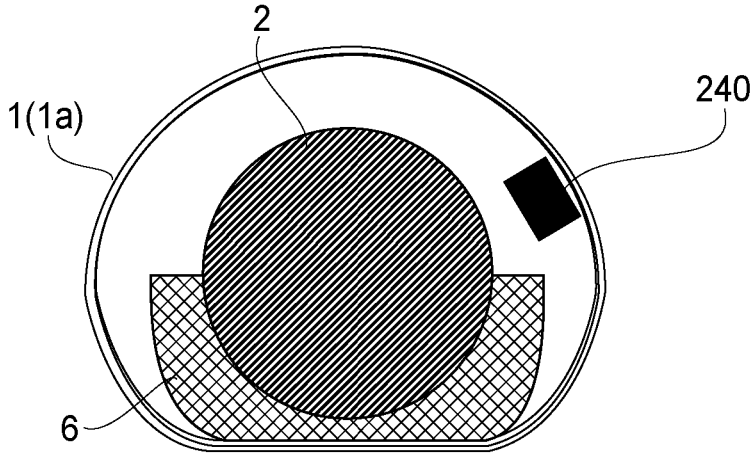

Here, on the X-axis, a region from 0 to L1 is referred to as region 1, a region from L1 to L2 where the temperature detecting element 240 exists is referred to as region 2, and a region from L2 to Lp is referred to as region 3. The cross-sectional structure in the region 1 is shown in (a) of FIG. 44, and the cross-sectional structure in the region 2 is shown in (b) of FIG. 12. As shown in (b) of FIG. 12, the temperature detecting element 240 is incorporated in the fixing sleeve 1, and therefore is an object to be subjected to calculation of the magnetic reluctance. In order to strictly make the magnetic reluctance calculation, the "magnetic reluctance per unit length" in each of the regions 1, 2 and 3 is obtained separately, and an integration calculation is performed depending on the length of each region, and then the combined magnetic reluctance is obtained by adding up the integral values.

First, the magnetic reluctance per unit length of each of components (parts) in the region 1 or 3 is shown in Table 3.

TABLE 3

| Item | U*1 | MC*2 | SG*3 | IEL*4 | EL*5 |
|---|---|---|---|---|---|
| CSA*6 | $m^2$ | 1.5E−04 | 1.0E−04 | 2.0E−04 | 1.5E−06 |
| RP*7 | | 1800 | 1 | 1 | 1 |
| P*8 | H/m | 2.3E−03 | 1.3E−06 | 1.3E−06 | 1.3E−06 |
| PUL*9 | H · m | 3.5E−07 | 1.3E−10 | 2.5E−10 | 1.9E−12 |
| MRUL*10 | 1/(H · m) | 2.9E+06 | 8.0E+09 | 4.0E+09 | 5.3E+11 |

*1"U" is the unit.
*2"MC" is the magnetic core.
*3"SG" is the sleeve guide.
*4"IEL" is the inside of the electroconductive layer.
*5"EL" is the electroconductive layer.
*6"CSA" is the cross-sectional area.
*7"RP" is the relative permeability.
*8"P" is the permeability.
*9"PUL" is the permeance per unit length.
*10"MRUL" is the magnetic reluctance per unit length.

In the region 1, a magnetic reluctance per unit length (rc1) of the magnetic core is as follows.

$$rc1=2.9\times10^6(1/(H\cdot m))$$

In the region between the electroconductive layer and the magnetic core, a magnetic reluctance per unit length ($r_a$) is a combined magnetic reluctance of a magnetic reluctance per unit length ($r_f$) of the film (sleeve) guide and a magnetic reluctance per unit length ($r_{air}$) of the inside of the electroconductive layer. Accordingly, the magnetic reluctance $r_a$ can be calculated using the following formula (529).

$$\frac{1}{r_a} = \frac{1}{r_f} + \frac{1}{r_{air}} \tag{529}$$

As a result of the calculation, a magnetic reluctance $r_{a1}$ in the region 1 and a magnetic reluctance $r_{a1}$ in the region 1 are follows.

$$r_{a1}=2.7\times10^{9}(1/(H\cdot m))$$

$$r_{s1}=5.3\times10^{11}(1/(H\cdot m))$$

Further, the region 3 is equal in length to the region 1, and therefore magnetic reluctance values in the region 3 are as follows.

$$r_{c3}=2.9\times10^{6}(1/(H\cdot m))$$

$$r_{a3}=2.7\times10^{9}(1/(H\cdot m))$$

$$r_{s3}=5.3\times10^{11}(1/(H\cdot m))$$

Next, the magnetic reluctance per unit length of each of components parts) in the region 2 is shown in Table 4.

TABLE 4

| Item | U*1 | MC*2 | SG*3 | T*4 | IEL*5 | EL*6 |
|---|---|---|---|---|---|---|
| CSA*7 | $m^2$ | 1.5E−04 | 1.0E−04 | 2.5E−05 | 1.72E−04 | 1.5E−06 |
| RP*8 | | 1800 | 1 | 1 | 1 | 1 |
| P*9 | H/m | 2.3E−03 | 1.3E−06 | 1.3E−06 | 1.3E−06 | 1.3E−06 |
| PUL*10 | H · m | 3.5E−07 | 1.3E−10 | 3.1E−11 | 2.2E−10 | 1.9E−12 |
| MRUL*11 | 1/(H · m) | 2.9E+06 | 8.0E+09 | 3.2E+10 | 4.6E+09 | 5.3E+11 |

*1"U" is the unit.
*2"MC" is the magnetic core.
*3"SG" is the sleeve guide.
*4"T" is the thermistor (temperature detecting member).
*6"EL" is the electroconductive layer.
*7"CSA" is the cross-sectional area.
*8"RP" is the relative permeability.
*9"P" is the permeability.
*10"PUL" is the permeance per unit length.
*11"MRUL" is the magnetic reluctance per unit length.

In the region 2, a magnetic reluctance per unit length (rc2) of the magnetic core is as follows.

$$rc2=2.9\times10^{6}(1/(H\cdot m))$$

In the region between the electroconductive layer and the magnetic core, a magnetic reluctance per unit length ($r_a$) is a combined magnetic reluctance of a magnetic reluctance per unit length ($r_f$) of the sleeve guide, a magnetic reluctance per unit length ($r_t$) of the temperature detecting element (thermistor) and a magnetic reluctance per unit length ($r_{air}$) of the inside air of the electroconductive layer 1*a*. Accordingly, the magnetic reluctance $r_a$ can be calculated using the following formula (530).

$$\frac{1}{r_a} = \frac{1}{r_t} + \frac{1}{r_f} + \frac{1}{r_{air}} \tag{530}$$

As a result of the calculation, a magnetic reluctance per unit length ($r_{a2}$) in the region 1 and a magnetic reluctance per unit length ($r_{s2}$) in the region 2 are follows.

$$r_{a2}=2.7\times10^{9}(1/(H\cdot m))$$

$$r_{s2}=5.3\times10^{11}(1/(H\cdot m))$$

The region 3 is equal in calculating method to the region 1, and therefore the calculating method in the region 3 will be omitted.

The reason why $r_{a1}=r_{a2}=r_{a3}$ is satisfied with respect to the magnetic reluctance per unit length ($r_a$) of the region between the electroconductive layer and the magnetic core will be described. In the magnetic reluctance calculation in the region 2, the cross-sectional area of the temperature detecting element (thermistor) 240 is increased, and the cross-sectional area of the inside air of the electroconductive layer is decreased. However, the relative permeability of both of the (thermistor) 240 and the electroconductive layer is 1, and therefore the magnetic reluctance is the same independently of the presence or absence of the thermistor 240 after all.

That is, in the case where only the non-magnetic material is disposed in the region between the electroconductive layer 1*a* and the magnetic core 2, calculation accuracy is sufficient even when the calculation of the magnetic reluctance is similarly treated as in the case of the inside air. This is because in the case of the non-magnetic material, the relative permeability becomes a value almost close to 1. On the other hand, in the case of the magnetic material (such as nickel, iron or silicon steel), the magnetic reluctance in the region where the magnetic material exists may preferably be calculated separately from the material in another region.

Integration of magnetic reluctance R (A/Wb(1/h)) as the combined magnetic reluctance with respect to the generatrix direction of the electroconductive layer 1*a* can be calculated using magnetic reluctance values r1, r2 and r3 (1/(H·m)) in the respective regions as shown in the following formula (531).

$$R = \int_{0}^{L1} r1dl1 + \int_{L1}^{L2} r2dl1 + \int_{L2}^{Lp} r3dl1 = r1(L1-0) + r2(L2-L1) + r3(LP-L2) \tag{531}$$

Accordingly, a magnetic reluctance Rc (H) of the core in a section from one end to the other end in the maximum recording material feeding region (maximum passing region width of the image on the recording material) can be calculated as shown in the following formula (532).

$$R_c = \int_0^{L1} r_c1\,dl1 + \int_{L1}^{L2} r_c2\,dl1 + \int_{L2}^{Lp} r_c3\,dl1 = r_c1(L1-0) + r_c2(L2-L1) + r_c3(LP-L2) \quad (532)$$

Further, a combined magnetic reluctance Ra (H) of the region, between the electroconductive layer and the magnetic core, in the section from one end to the other end in the maximum recording material feeding region can be calculated as shown in the following formula (533).

$$R_a = \int_0^{L1} r_a1\,dl1 + \int_{L1}^{L2} r_a2\,dl1 + \int_{L2}^{Lp} r_a3\,dl1 = r_a1(L1-0) + r_a2(L2-L1) + r_a3(LP-L2) \quad (533)$$

Further, a combined magnetic reluctance Rs (H) of the electroconductive layer in the section from one end to the other end in the maximum recording material feeding region can be calculated as shown in the following formula (534).

$$R_s = \int_0^{L1} r_s1\,dl1 + \int_{L1}^{L2} r_s2\,dl1 + \int_{L2}^{Lp} r_s3\,dl1 = r_s1(L1-0) + r_s2(L2-L1) + r_s3(LP-L2) \quad (534)$$

A calculation result in each of the regions 1, 2 and 3 is shown in Table 5.

TABLE 5

| Item | Region 1 | Region 2 | Region 3 | MCR*1 |
|---|---|---|---|---|
| ISP*2 | 0 | 102.95 | 112.95 | |
| IEP*3 | 102.95 | 112.95 | 215.9 | |
| D*4 | 102.95 | 10 | 102.95 | |
| pc*5 | 3.5E−07 | 3.5E−07 | 3.5E−07 | |
| rc*6 | 2.9E+06 | 2.9E+06 | 2.9E+06 | |
| Irc*7 | 3.0E+08 | 2.9E+07 | 3.0E+08 | 6.2E+08 |
| pm*8 | 3.7E−10 | 3.7E−10 | 3.7E−10 | |
| rm*9 | 2.7E+09 | 2.7E+09 | 2.7E+09 | |
| Irm*10 | 2.8E+11 | 2.7E+10 | 2.8E+11 | 5.8E+11 |
| ps*11 | 1.9E−12 | 1.9E−12 | 1.9E−12 | |
| rs*12 | 5.3E+11 | 5.3E+11 | 5.3E+11 | |
| Irs*13 | 5.4E+13 | 5.3E+12 | 5.4E+13 | 1.1E+14 |

*1"CMR" is the combined magnetic reluctance.
*2"ISP" is an integration start point (mm).
*3"IEP" is an integration end point (mm).
*4"D" is the distance (mm).
*5"pc" is the permeance per unit length (H.m).
*6"rc" is the magnetic reluctance per unit length (1/(H · m)).
*7"Irc" is integration of the magnetic reluctance rm (A/Wb(1 · H)).
*8"pm" is the permeance per unit length (H · m).
*9"rm" is the magnetic reluctance per unit length (1/(H · m)).
*10"Irm" is integration of the magnetic reluctance rm (A/Wb(1/H)).
*11"ps" is the permeance per unit length (H · m).
*12"rs" is the magnetic reluctance per unit length (1/(H · m)).
*13"Irs" is integration of the magnetic reluctance rm (A/Wb(1/H)).

From Table 5, Rc, Ra and Rs are follows.

$Rc=6.2\times10^{8}(1/H)$ $Ra=5.8\times10^{11}(1/H)$ $Rs=1.1\times10^{14}(1/H)$

The combined magnetic reluctance Rsa of Rs and Ra can be calculated by the following formula (535).

$$\frac{1}{R_{sa}} = \frac{1}{R_s} + \frac{1}{R_a} \quad (535)$$

$$R_{sa} = \frac{R_a \times R_s}{R_a + R_s}$$

From the above calculation, Rsa=$5.8\times10^{11}$ (1/h) holds, thus satisfying the following formula (536).

$$0.28\times R_{sa} \geq Rc \quad (536)$$

As described above, in the case of the fixing device in which a non-uniform cross-sectional shape is formed with respect to the generatrix direction of the electroconductive layer, the region is divided into a plurality of regions, and the magnetic reluctance is calculated for each of the divided regions, and finally, the combined permeance or magnetic reluctance may be calculated from the respective magnetic reluctance values. However, in the case where the member to be subjected to the calculation is the non-magnetic material, the permeability is substantially equal to the permeability of the air, and therefore the calculation may be made by regarding the member as the air.

Next, the component (part) to be included in the above calculation will be described. With respect to the component which is disposed between the electroconductive layer and the magnetic core and at least a part of which is placed in the maximum recording material feeding region (0 to Lp), it is desirable that the permeance or the magnetic reluctance thereof is calculated.

On the other hand, with respect to the component (member) disposed outside the electroconductive layer, there is no need to calculate the permeance or the magnetic reluctance thereof.

This is because as described above, in the Faraday's law, the induced electromotive force is proportional to a change with time of the magnetic flux vertically passing through the circuit, and therefore is independently of the magnetic flux outside the electroconductive layer. Further, with respect to the member disposed out of the maximum recording material feeding region, with respect to the generatrix direction of the electroconductive layer this member has no influence on the heat generation of the electroconductive layer, and therefore there is no need to make the calculation.

<Frequency and Longitudinal Temperature Distribution of Fixing Sleeve>

In the fixing device constitution in this embodiment, such a phenomenon that a longitudinal temperature distribution of the fixing sleeve 1 was changed by changing the frequency of the current outputted from the high-frequency converter 16 was observed.

Figure 13:
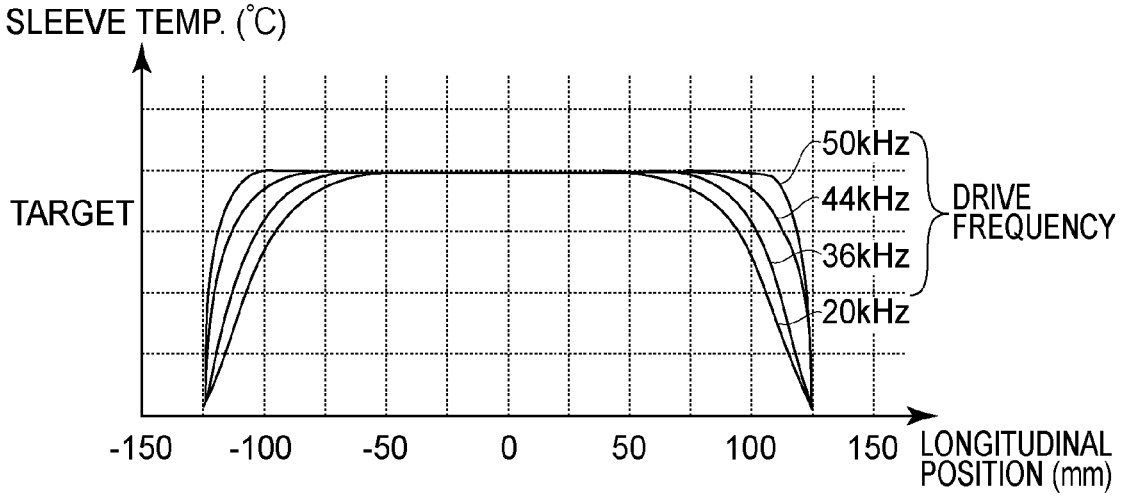
FIG. 13 is a graph showing a relationship between a drive frequency and a longitudinal heat generation distribution.

FIG. 13 is a graph showing the longitudinal temperature distribution of the fixing sleeve 1 when the frequency is changed. From FIG. 13, it is understood that in the longitudinal temperature distribution of the fixing sleeve 1, an end portion temperature increases with an increasing frequency from 20 kHz to 50 kHz.

In the following, the phenomenon that the longitudinal temperature distribution of the fixing sleeve 1 is changed by changing the frequency will be described.

Figure 14:
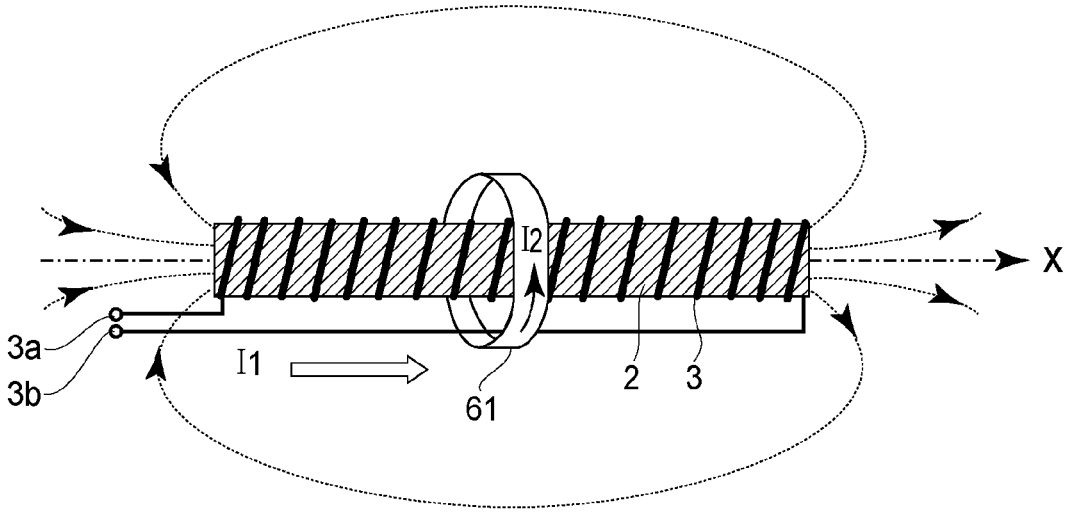
FIG. 14 is a schematic view showing a magnetic field in the case where a current flows into the exciting coil in an arrow direction.

FIG. 14 is a schematic view showing a magnetic field at the instant when the current increases in an arrow I1 direction in the exciting coil 3. The magnetic core 2 functions as a member for inducing the magnetic lines of force generated in the exciting coil 3 into the inside thereof to form a magnetic path. For that reason, the magnetic lines of force have a shape such that the magnetic lines of force concentratedly pass through the magnetic path and diffuse at the end portion of the magnetic core 2, and then are connected at portions far away from the outer peripheral surface of the magnetic core 2. In FIG. 14, such a connection state of the magnetic lines of force is partly omitted in some cases. A cylindrical circuit 61 having a small longitudinal width was provided so as to vertically surround this magnetic path. Inside the magnetic core 2, an AC magnetic field (in which a magnitude and a direction of the magnetic field repeat change thereof with time) is generated.

With respect to a circumferential direction of this circuit 61, the induced electromotive force is generated in accordance with the Faraday's law. The Faraday's law is such that the magnitude of the induced electromotive force generated in the circuit 61 is proportional to a ratio of a change in magnetic field penetrating through the circuit 61, and the induced electromotive force is represented by the following formula (1).

$$V = -N\frac{\Delta\Phi}{\Delta t} \tag{1}$$

V: inducted electromotive force

Figure 15:
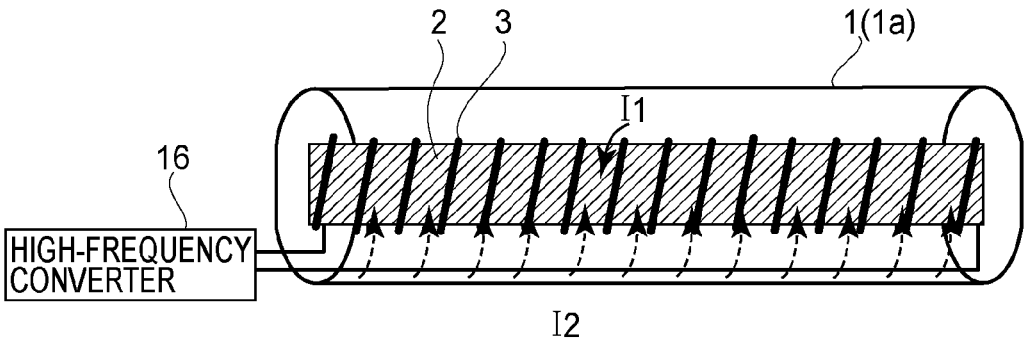
FIG. 15 is a schematic view showing a circumferential direction current flowing into a heat generating layer.

N: the number of winding of coil $\Delta\phi/\Delta t$: change in magnetic flux vertically penetrating through the circuit in a minute time $\Delta t$ It can be considered that the heat generating layer 1*a* is formed by connecting many short cylindrical circuits 61 with respect to the longitudinal direction. Accordingly, the heat generating layer 1*a* can be formed as shown in FIG. 15. When the current I1 is passed through the exciting coil 3, the AC magnetic field is formed inside the magnetic core 2, and the induced electromotive force is exerted over the entire longitudinal region of the heat generating layer 1*a* with respect to the circumferential direction, so that a circumferential direction current I2 indicated by broken lines flows over the entire longitudinal region. The heat generating layer 1*a* has an electric resistance, and therefore the Joule heat is generated by a flow of this circumferential direction current I2. As long as the AC magnetic field is continuously formed inside the magnetic core 2, the circumferential direction current I2 is continuously formed while changing direction thereof.

This is the heat generation principle of the heat generating layer 1*a* in the constitution of the present invention. Incidentally, in the case where the current I1 is a high-frequency AC current of 50 kHz in frequency, also the circumferential direction current I2 is the high-frequency AC current of 50 kHz in frequency.

Figure 16:
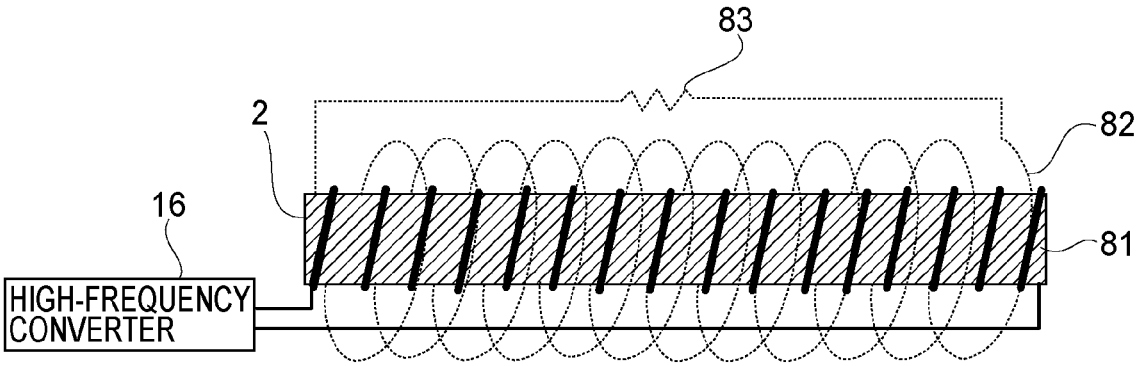
FIG. 16 is a schematic view showing a magnetic coupling of a coaxial transformer having a shape that a primary coil and a secondary coil are wound.

As described above with reference to FIG. 15, I1 represents the direction of the current flowing into the exciting coil 3, and the induced current flows in the arrow I2 direction, which is a direction of canceling the AC magnetic field formed by the current I1, indicated by the broken lines in the entire circumferential region of the heat generating layer 1*a*. A physical model in which the current I2 is induced is, as shown in FIG. 16, equivalent to the magnetic coupling of the coaxial transformer having a shape in which a primary coil 81 indicated by a solid line and a secondary coil 82 indicated by a dotted line. The secondary winding 82 constituting the secondary coil forms a circuit in which a resistor 83 is included. By the AC voltage generated from the high-frequency converter 16, the high-frequency current is generated in the primary winding (coil) 81, with the result that the induced electromotive force is exerted on the secondary winding 82, and thus is consumed as heat by the resistor 83. The Joule heat generated in the heat generating layer 1*a* is modeled as the secondary winding 82 and the resistor 83.

Figure 17:
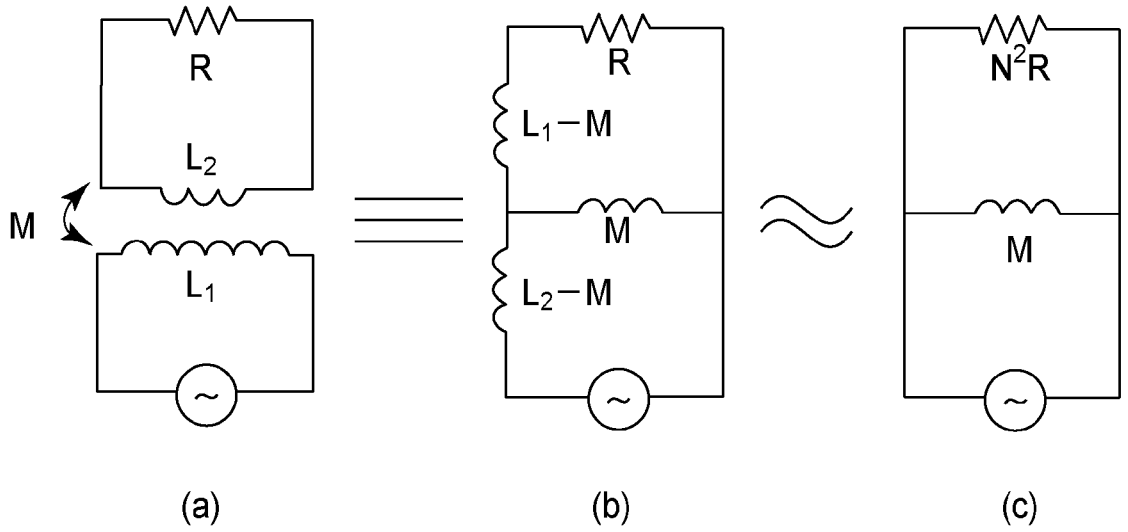
FIG. 17 is a schematic view showing an equivalent circuit.

An equivalent circuit of the model view shown in FIG. 16 is shown in (a) of FIG. 17. In (a) of FIG. 17, L1 is an inductance of the primary winding 81 in FIG. 16, L2 is an inductance of the secondary winding 82 in FIG. 16, M is a mutual inductance between the primary winding 81 and the secondary winding 82, and R is the resistor 83.

The equivalent circuit shown in (a) of FIG. 17 can be equivalently converted into an equivalent circuit shown in (b) of FIG. 17. In order to consider a further simplified model, the case where the mutual inductance M is sufficiently large and L1, L2 and M are nearly equal to each other is assumed. In that case, (L1−M) and (L2−M) are sufficiently small, and therefore the circuit of (b) of FIG. 17 can be approximated to an equivalent circuit shown in (c) of FIG. 17.

As described above, the constitution of the present invention shown in FIG. 15 will be considered as a replaced constitution represented by the approximated equivalent circuit shown in (c) of FIG. 17. First, the resistance will be described. In a state of (a) of FIG. 17, an impedance in the secondary side is the electric resistance R with respect to the circumferential direction of the heat generating layer 1*a*. In the transformer, the impedance in the secondary side is an equivalent resistance R' which is $N^2$ times (N: a winding number ratio of the transformer) that in the primary side.

Here, the winding number ratio N can be considered as N=18 by regarding the winding number for the heat generating layer 1*a* as one with respect to the winding number (18 in this embodiment) of the exciting coil 3 per the winding number of the winding in the primary side (heat generating layer 1*a*). Therefore, it can be considered that $R'=N^2R=18^2R$ holds, so that the equivalent resistance R shown in (c) of FIG. 17 becomes larger with a larger winding number.

Figure 18:
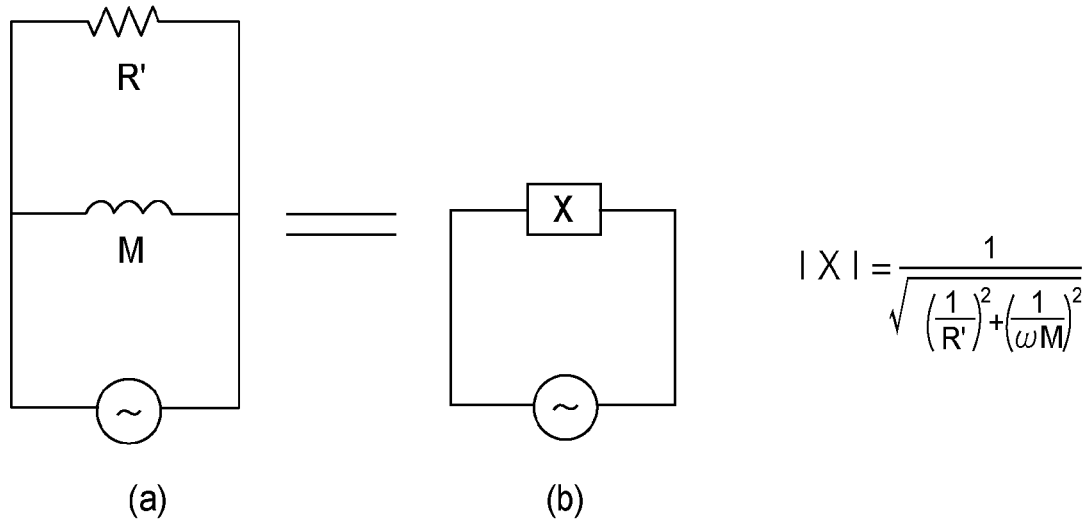
FIG. 18 is a schematic view showing an equivalent circuit.

In (b) of FIG. 18, a synthetic impedance X is defined, and the above equivalent circuit is further simplified. The synthetic impedance X is represented by the following formula (2).

$$\frac{1}{X} = \frac{1}{R'} + \frac{1}{j\omega M},\ (\omega = 2\pi f) \tag{2}$$

$$|X| = \frac{1}{\sqrt{\left(\frac{t}{R'}\right)^3 + \left(\frac{1}{\omega M}\right)^2}}$$

According to this formula, the synthetic impedance X has frequency dependency in the term of $(1/\omega M)2$. This means that not only the resistance R', but also the inductance M contribute to the synthetic impedance. Further, the dimension of the impedance is ω, and therefore this means that the load resistance has a frequency dependency.

This phenomenon that the synthetic impedance X varies depending on the frequency will be qualitatively described in order to understand an operation of the circuit. In the case where the frequency is low, the circuit makes a response like that of a series circuit. That is, the inductance becomes close to a short circuit, so that the current flows toward the inductance. On the other hand, in the case where the frequency is high, the inductance is close to an open state, so that the current flows toward the resistor R.

As a result, the synthetic impedance X exhibits behavior that the synthetic impedance is small when the frequency is low and is large when the frequency is high. In the case where a high frequency of 20 kHz or more is used, the dependency of the synthetic impedance X on the frequency as is large. Accordingly, in the case of the high frequency of 20 kHz or more, the influence of the inductance M on the synthetic impedance becomes non-negligible. This simplified equivalent circuit will be used in explanation described later.

<Phenomenon that Heat Generation Amount Lowers in the Neighborhood of Magnetic Core End Portions>

Figure 19:
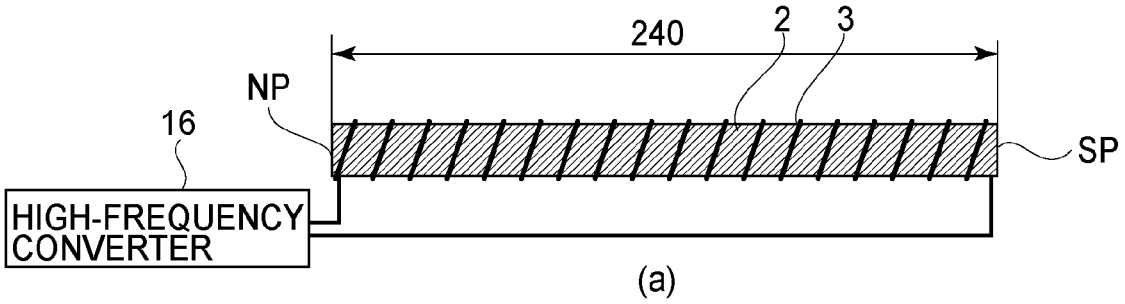
FIG. 19 is a schematic view showing a winding interval of the exciting coil.
Figure 20:
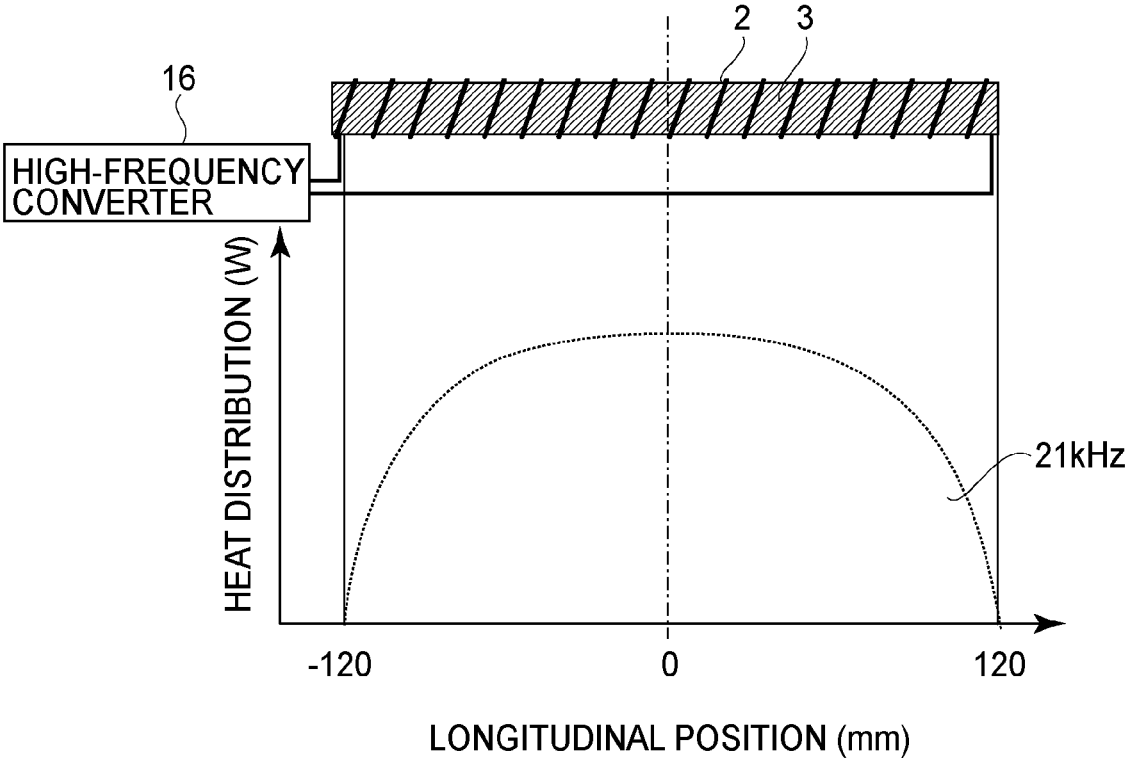
FIG. 20 is a schematic view showing a heat generation amount distribution.

Here "a phenomenon that heat generation amount decreases in the neighborhood of magnetic core end portions" will be described. As shown in FIG. 19, the magnetic core 2 forms a rectilinear open magnetic path having magnetic poles NP and SP. In the constitution in this embodiment, although downsizing can be realized by employing the open magnetic path, the heat generation amount decreases in the neighborhood of the end portions of the magnetic core 2 as shown in FIG. 20. This is associated largely with the formation of the open magnetic path by the magnetic core 2.

Specifically, the following factors 1) and 2) are associated with the generation of the heat generation non-uniformity.

1) Decrease in apparent permeability at magnetic core end portions.

2) Decrease in synthetic impedance at magnetic core end portions

Hereinafter, details will be described.

1) Decrease in Apparent Permeability at Magnetic Core End Portions

Figure 21:
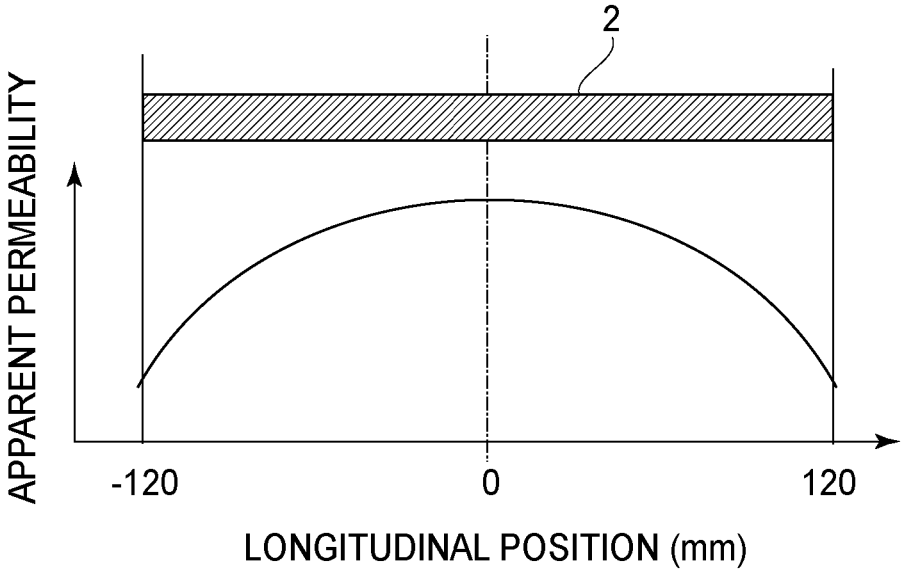
FIG. 21 is a schematic view for illustrating a phenomenon that an apparent permeability μ is lowered at magnetic core end portions.

FIG. 21 is a conceptual drawing for illustrating a phenomenon that the apparent permeability μ is lower at the end portions than at the central portion of the magnetic core 2. The reason why this phenomenon is generated will be described specifically. In a uniform magnetic field H, the space magnetic flow density B in a magnetic field region such that magnetization of an object is substantially proportional to the external magnetic field is represented by the following formula (3).

$$B=\mu H \tag{3}$$

That is, when a substance having high member μ is placed in the magnetic field H, it is possible to create the magnetic flow density B having a height ideally proportional to a height of the permeability. In the present invention, this space in which the magnetic flow density is high is used as the magnetic path. Particularly, the magnetic path is formed as a closed magnetic path in which the magnetic path itself is formed in a loop or as an open magnetic path in which the magnetic path is interrupted by providing an open end or the like, but in the present invention, use of the open magnetic path is a feature.

Figure 22:
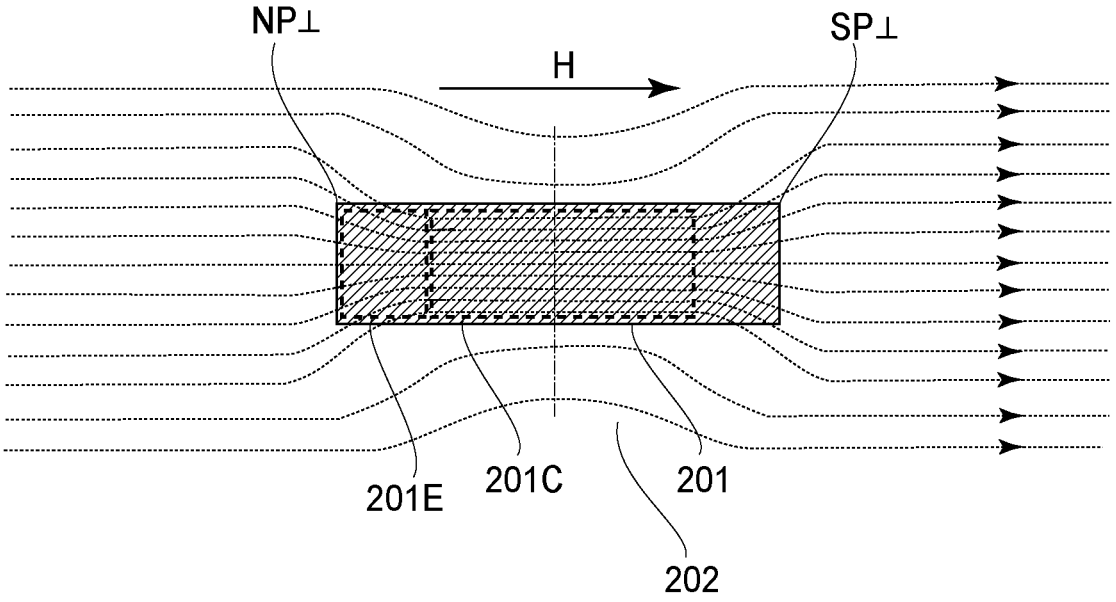
FIG. 22 is a schematic view showing a shape of magnetic flux in the case where ferrite and air are disposed in a uniform magnetic field.

FIG. 22 shows the shape of magnetic flux in the case where ferrite 201 and air 202 are disposed in the uniform magnetic field H. The ferrite 201 has the open magnetic path, relative to the air 202, having boundary surfaces NP⊥ and SP⊥ perpendicular to the magnetic lines of force. In the case where the magnetic field H is generated in parallel to the longitudinal direction of the magnetic core, the magnetic lines of force are, as shown in FIG. 22, such that the density is low in the air and is high at a central portion 201C of the magnetic core. Further, compared with the central portion 201C, the magnetic flow density is low at an end portion 201E of the magnetic core.

The reason why the magnetic flow density becomes small at the end portion of the ferrite is based on a boundary condition between the air and the ferrite. At the boundary surfaces NP⊥ and SP⊥ perpendicular to the magnetic lines of force, the magnetic flow density is continuous, and therefore the magnetic flow density is high at an air portion contacting the ferrite in the neighborhood of the boundary surface and is low at the ferrite end portion 201E contacting the air. As a result, the magnetic flow density at the ferrite end portion 201E becomes small. This phenomenon looks as if the end portion permeability decreases, and therefore, in this embodiment, the phenomenon is expressed as "Decrease in apparent permeability at magnetic core end portions".

Figure 23:
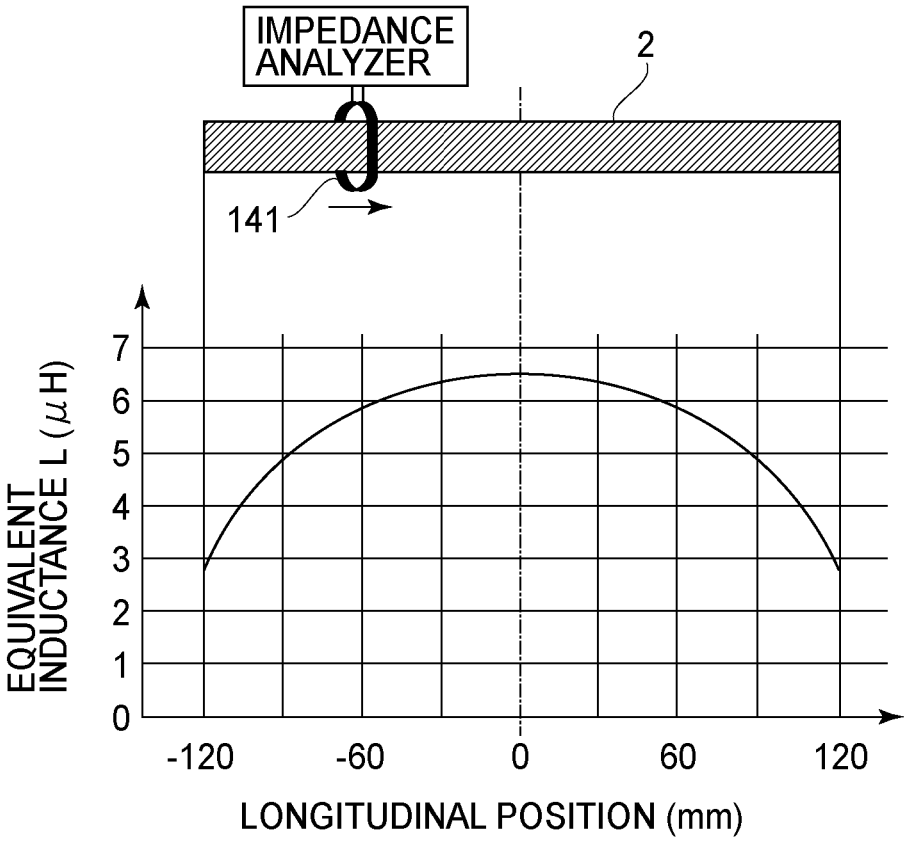
FIG. 23 is a schematic view for illustrating scanning of a magnetic core with a coil.

This phenomenon can be verified indirectly using an impedance analyzer. In FIG. 23, the magnetic core 2 is inserted into a coil 141 (winding number N: 5) of 30 mm in diameter, and scanning with the coil 141 is made with respect to an arrow direction. In this case, the coil 141 is connected with the impedance analyzer at both ends thereof. When an equivalent inductance L (frequency: 50 kHz) from the both ends of the coil is measured, a mountain-shape distribution as shown in the graph in FIG. 15 is obtained. The equivalent inductance L at each of the end portions of the magnetic core 2 is attenuated to ½ or less of that at the central portion. The equivalent inductance is represented by the following formula (4).

$$L=\frac{\mu N^2 S}{l} \tag{4}$$

In the formula (4), μ is the magnetic core permeability, N is the winding number, l is the length of the coil, and S is a cross-sectional area of the coil.

The shape of the coil 141 is unchanged, and therefore in this experiment, the parameters S, N and l are unchanged. Accordingly, the mountain-shaped distribution is caused by "Decrease in apparent permeability at member end portions".

In summary, the phenomenon of "Decrease in apparent permeability at magnetic core end portions" appears by forming the magnetic core 2 so as to have the open magnetic path.

Figure 24:
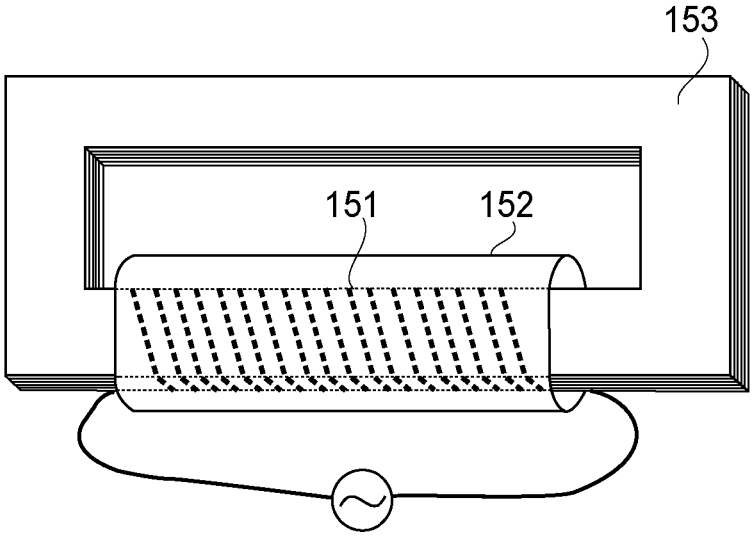
FIG. 24 is an illustration in the case where a closed magnetic path is formed.

In the case of the closed magnetic path, the above phenomenon does not appear. The case of the closed magnetic path as shown in FIG. 24 will be described.

A magnetic core 153 forms a loop outside an exciting coil 151 and a heat generating layer 152, so that the closed magnetic path is formed. In this case, different from the above-described case of the open magnetic path, the magnetic lines of force pass through only the inside of the closed magnetic path, and there are no boundary surfaces (NP⊥ and SP⊥ in FIG. 22) perpendicular to the magnetic lines of force. Accordingly, it is possible to form a uniform magnetic flow density over the entirety of the inside of the magnetic core 153 (i.e., over a full circumference of the magnetic path).

2) Decrease in Synthetic Impedance at Magnetic Core End Portions

Figure 25:
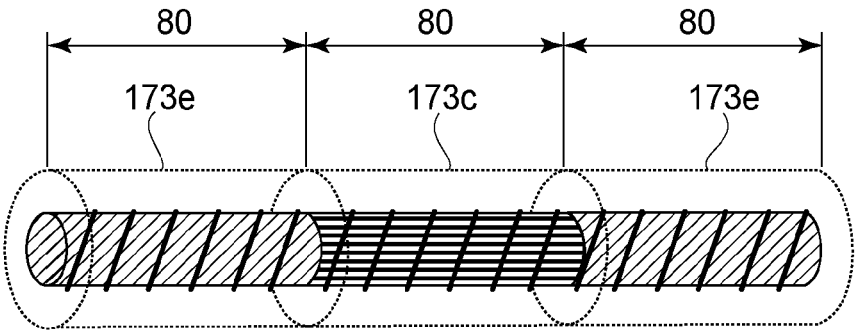
In FIG. 25, (a) and (b) are arrangement views each showing of a heat generating layer and a magnetic core which are divided into three portions.
Figure 25:
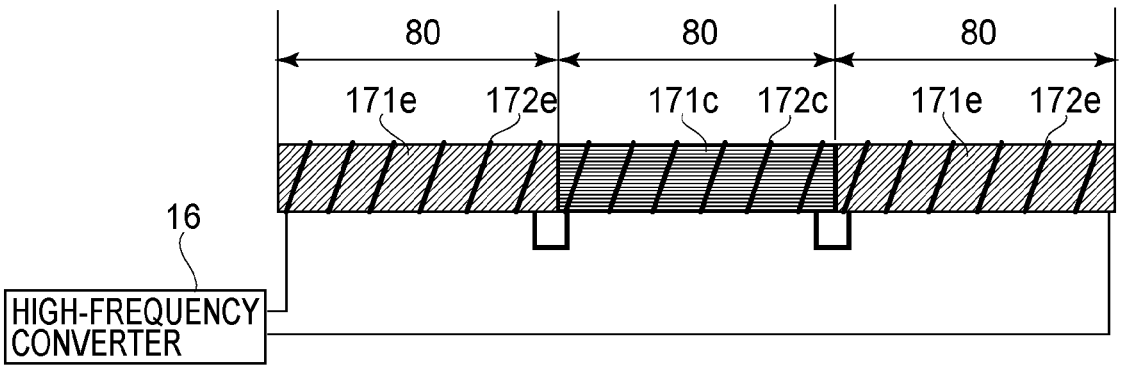

In this constitution, the apparent permeability has a distribution with respect to the longitudinal direction. In order to explain this phenomenon by using a simple model, a description will be provided using a constitution shown in FIG. 25. In (a) of FIG. 25, compared with the constitution shown in FIG. 19, the magnetic core and the heat generating layer are divided into three portions with respect to the longitudinal direction. The heat generating layer includes, as shown in (a) of FIG. 25, two end portions 173*e* and a central portion 173*c*, which have the same shape and the same physical property and which have the same longitudinal dimension of 80 mm. The resistance value of each end portion 173*e* with respect to the circumferential direction is Re, and the resistance value of the central portion 173*c* with respect to the circumferential direction is Rc. The circumferential direction resistance means a resistance value in the case where a current path is formed with respect to the circumferential direction of the cylinder.

The circumferential direction resistance at that time is the same value, i.e., Re=Rc (=R). The magnetic core is divided into two end portions 171*e* (permeability: μe) and a central portion 171*c* (permeability: μc) which have the same longitudinal dimension of 80 mm. Values of the permeability of the end portion 171*e* and the central portion 171*c* satisfy the relationship of: μe (end portion)<μc (central portion). In order to consider the above-described phenomenon based on a simple physical model to the possible extent, a change in individual apparent permeability at the inside of each of the end portion 171*e* and the central portion 171*c* is not considered.

Figure 26:
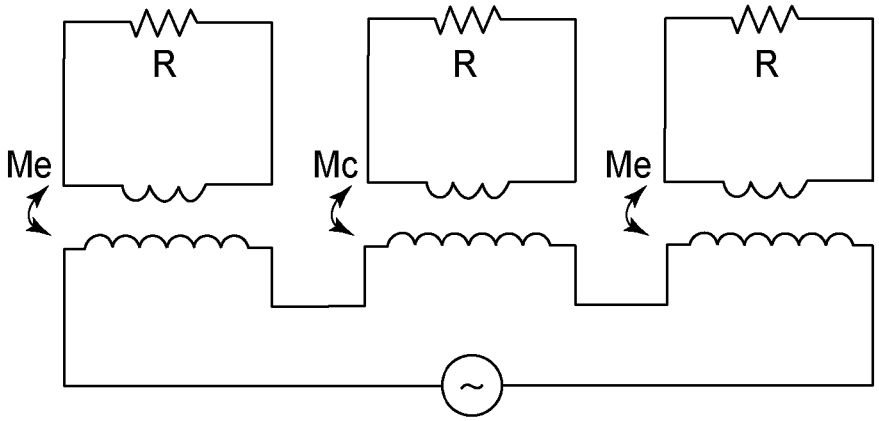
FIG. 26 is a schematic view of an equivalent circuit.
Figure 27:
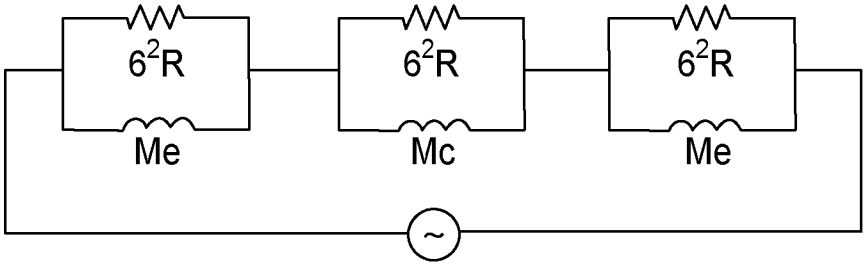
FIG. 27 is a schematic view of a simplified equivalent circuit.

The winding is, as shown in (b) of FIG. 25, such that the winding number Ne of each of two exciting coils 172*e* and an exciting coil 171*c* is 6. Further, the exciting coils 172*e* and the exciting coil 172*c* are connected in series. Further, an interaction between the exciting coils at the end portion and the central portion is sufficiently small, so that the above-described divided three circuits can be modeled as three branched circuits as shown in FIG. 26. The permeability values of the exciting coils satisfy the relationship of: μe<μc, and therefore a relationship of the mutual inductance is also Me<Mc. A further simplified model is shown in FIG. 27. When an equivalent resistance of each of the circuits is seen from the primary side, $R'=6^2R$ holds at the end portions and $R'=6^2R$ holds at the central portion. Therefore, when synthetic impedances Xe and Xc are obtained, Xe and Xc are represented by the following formulas (5) and (6).

$$|X_e| = \frac{1}{\sqrt{\left(\frac{1}{6^2R}\right)^2 + \left(\frac{1}{\omega M_e}\right)^2}} \tag{5}$$

$$|X_c| = \frac{1}{\sqrt{\left(\frac{1}{6^2R}\right)^2 + \left(\frac{1}{\omega M_c}\right)^2}} \tag{6}$$

Figure 28:
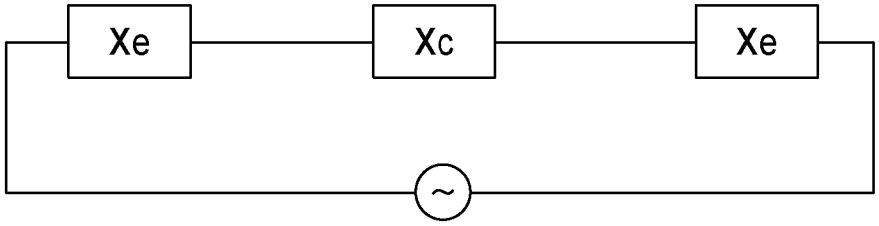
FIG. 28 is a schematic view of a further simplified equivalent circuit.
Figure 29:
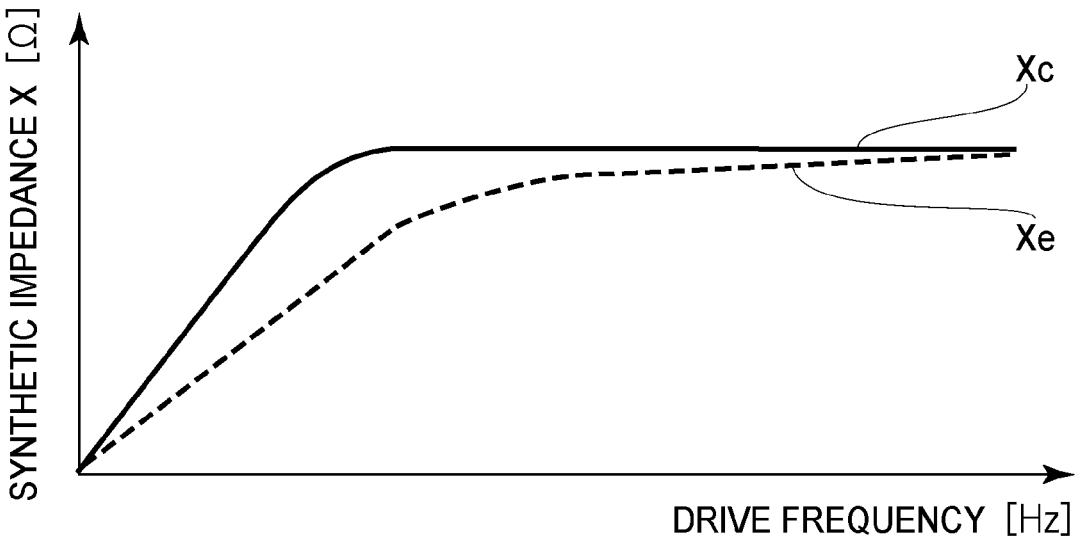
FIG. 29 is a graph showing a frequency characteristic of Xe and Xc.

When a parallel circuit portion of R and L is replaced with the synthetic impedance X, an equivalent circuit as shown in FIG. 28 is obtained. With respect to the frequency dependency of Xe and Xc, the relationship of the mutual inductance is Me<Mc, and therefore Xe<Xc holds as shown in FIG. 29, so that it is understood that there is a frequency dependency and that rising curves different in slope are obtained.

In the case where the AC voltage is applied from the high-frequency converter, in a series circuit of Xe and Xc shown in FIG. 28, a magnitude relationship of the heat generation amount is determined by the magnitude relationship between Xe and Xc. For that reason, as shown in FIG. 30, Qe<Qc holds, so that it is similarly understood that there is a frequency dependency and that rising curves are different from each other.

Figure 30:
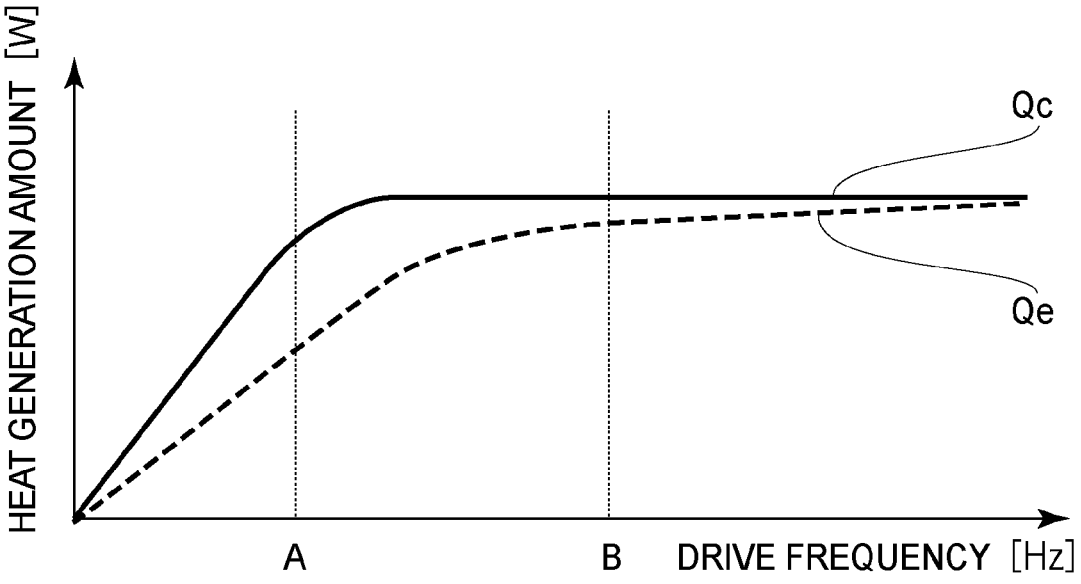
FIG. 30 is a graph showing a frequency characteristic of Qe and Qc.
Figure 31:
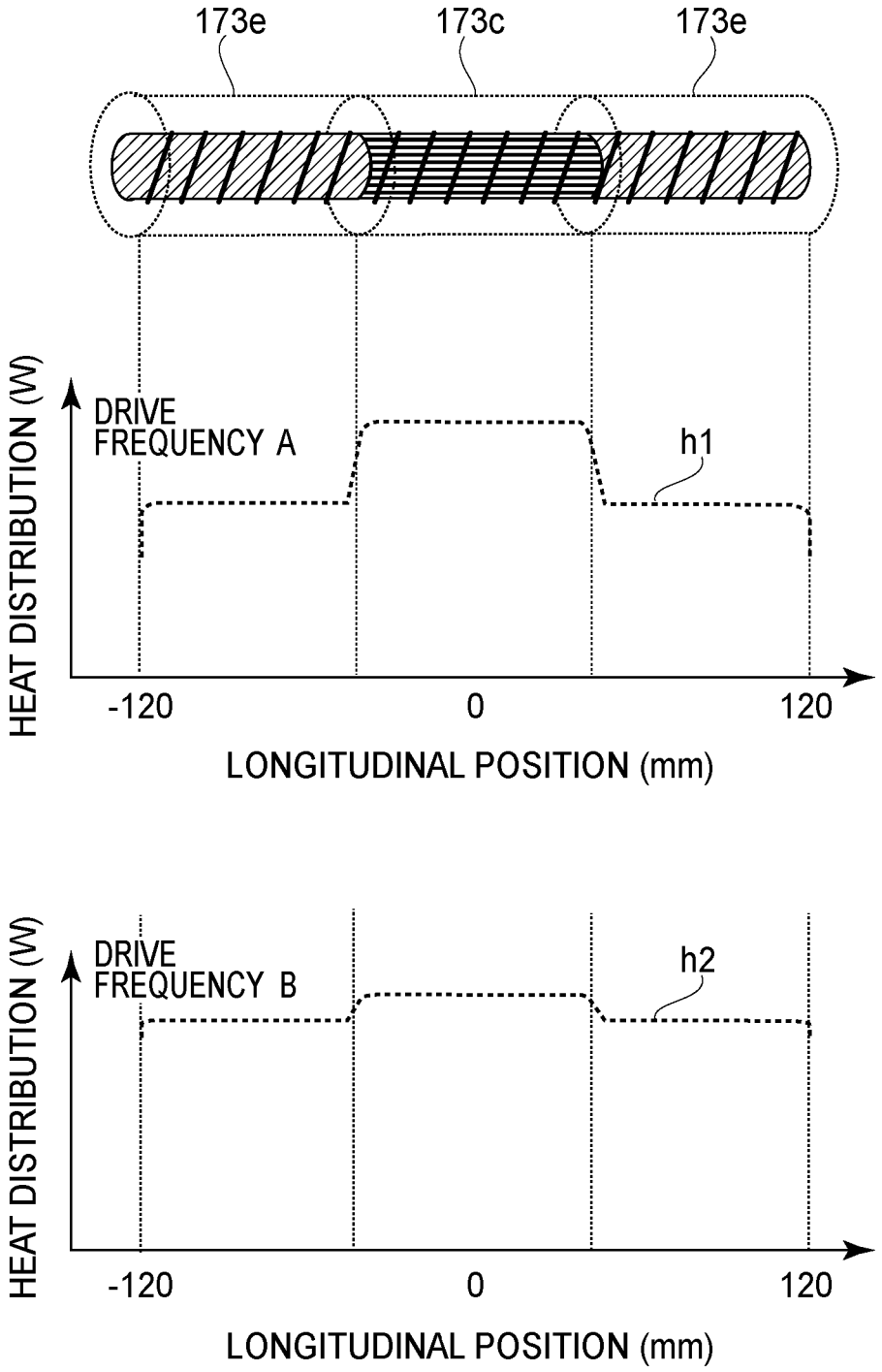
FIG. 31 illustrates a heat generation amount at a central portion and end portions.

Accordingly, in the example shown in this embodiment, for example, when AC currents having a frequency A and a frequency B shown in FIG. 30 are passed through the exciting coil, the frequency dependency of the heat generation amount is different between the central portion and the end portion. Further, in each of the cases, Xe/Xc, which is a ratio of the synthetic impedance, is different, and therefore as shown in each of h1 and h2 shown in FIG. 31, the longitudinal heat generation distribution is different in heat generation amount between the central portion and the end portion. This means that by changing the frequency, it becomes possible to change the heat generation ratio between the central portion and the end portion, i.e., the longitudinal heat generation distribution.

In the above model, the magnetic core is divided into three portions with respect to the longitudinal direction in order to explain the above-described phenomenon in a simple manner, but in an actual constitution shown in FIG. 19, the change in apparent permeability continuously is generated. Further, the interaction or the like between the inductances with respect to the longitudinal direction would be considered, and therefore a complicated circuit is formed. However, such a phenomenon that "the heat generation amount is different between the central portion and the end portion, so that the heat generation ratio is changed by changing the frequency", i.e., such a phenomenon that "the longitudinal heat generation distribution is changed by changing the frequency" is described above.

In the above, the winding manner of the coil with respect to the longitudinal direction was described using a simple model in the case where the coil is wound uniformly with respect to the longitudinal. In this case, Xe/Xc<1 holds theoretically, so that the heat generation distribution at the central portion and the end portions is always high at the central portion and low at the end portions.

On the other hand, the induced electromotive force depends on the winding number N of the coil, and therefore the longitudinal heat generation distribution can be changed by changing the winding number of the coil with respect to the longitudinal direction. In that case, for example, the coil is wound in a larger amount at the end portions than at the central portion, so that Xe/Sc>1, with the result that it is also possible to obtain, as the heat generation distribution between the central portion and the end portion, such a temperature distribution that the temperature is high at the end portions where the heat is generated in a larger amount at the end portions than at the central portion. In this way, the winding number or the like of the coil with respect to the longitudinal direction is adjusted to adjust the frequency, so that the heat generation amount at the central portion and the end portions is controlled, and thus it becomes possible to obtain an optimum longitudinal heat generation distribution.

<Electric Power Adjusting Method>

A method of adjusting electric power in this embodiment will be described. In the conventional heating device of the electromagnetic induction heating type, a method of adjusting the electric power by changing the frequency of the current was used in general.

Figure 32:
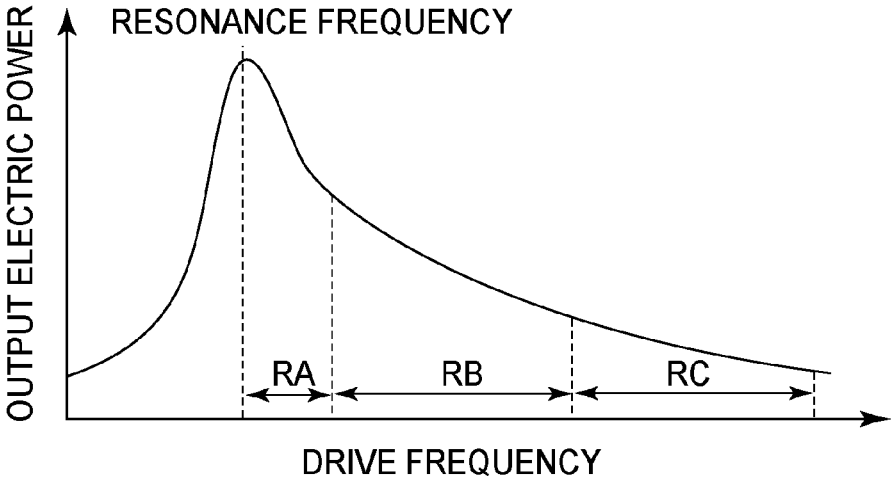
FIG. 32 is a graph showing a characteristic that an output voltage varies depending on a drive frequency.

In an electromagnetic induction heating type in which induction heating is made using a resonance circuit, as shown in a graph of FIG. 32, the output electric power changes depending on the frequency. For example, in the case where a region A is selected, the output electric power becomes a maximum, and with an increasing frequency in a region B and in a region C, the output electric power decreases.

This uses such a property that the electric power becomes a maximum when the frequency coincides with the resonance frequency of the circuit and that the electric power decreases when the frequency deviates from the resonance frequency. That is, the output voltage is not changed, but the frequency is changed from 21 kHz to 100 kHz, depending on the difference between the target temperature and the temperature detected by the temperature detecting element 9, and the output electric power is adjusted (Japanese Laid-Open Patent Application 2000-223253).

However, in this embodiment of the present invention, a desired heat generation distribution is obtained by adjusting the frequency, and therefore the electric power cannot be adjusted by the conventional method. In the present invention, the following electric power adjusting means is used.

In a frequency controller 45 shown in FIG. 4, the frequency is determined so that the fixing sleeve 1 has a desired target temperature longitudinal heat generation distribution. An engine controller 43 determines the target temperature of the fixing sleeve 1 on the basis of recording material information, image information, print number information and the like which are obtained from a printer controller 41. A fixing temperature controller 44 comprises the target temperature with a detection temperature of the temperature detecting element 9 and then determines the output voltage. In accordance with the above-determined voltage value, an amplitude of a voltage waveform is adjusted and outputted by an electric power controller 46.

Figure 33:
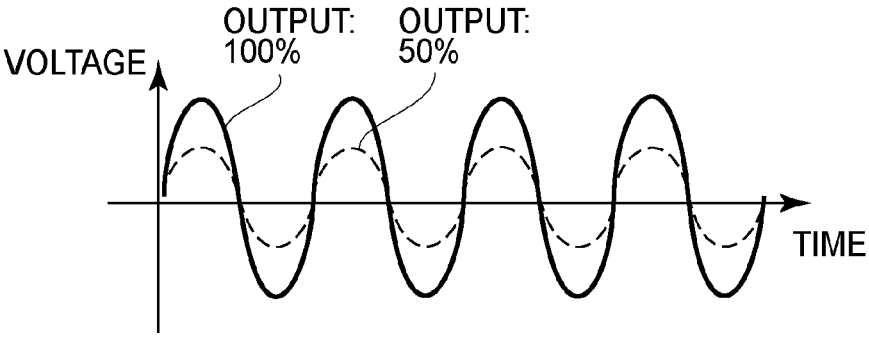
FIG. 33 is a schematic view showing waveforms of an output of 100% and an output of 50%.

In FIG. 33, as an example, voltage waveforms have a maximum voltage amplitude (100%) and a voltage amplitude of 50%. An outputted voltage is converted into a predetermined drive frequency by the high-frequency converter 16, and then is applied to the exciting coil.

As another method, the electric power may also be adjusted by ON/OFF time of the output voltage. In that case, the engine controller 43 determines an ON/OFF ratio of the output voltage. Depending on the above-determined ON/OFF ratio, the voltage is outputted from the electric power controller.

Figure 34:
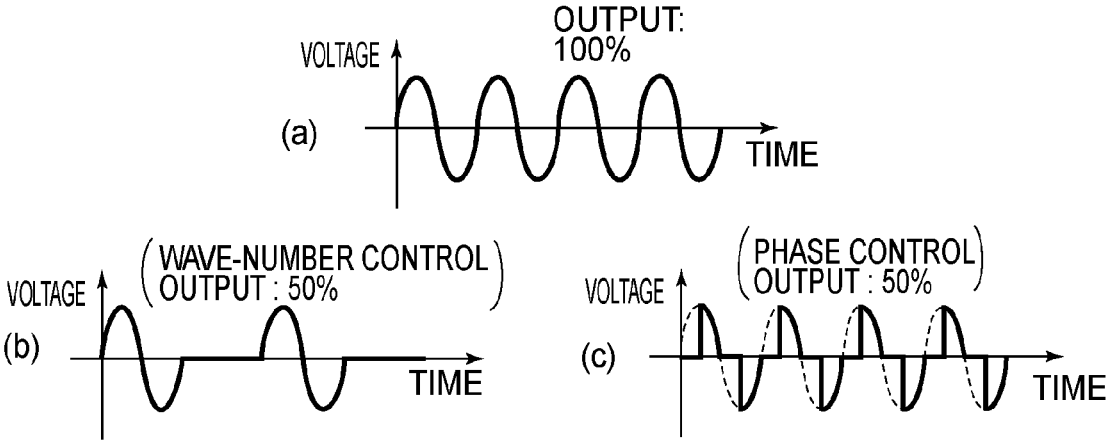
In FIG. 34, (a) to (c) are schematic views showing a waveform of an output of 100%, a waveform of an output of 50% (wave-number control) and a waveform of an output of 50% (phase control), respectively.

In FIG. 34, (a) shows a waveform of an output of 100%, (b) and (c) show waveforms each of an output of 50%. The control of the ON/OFF ratio may be effected by a method based on wave-number control ((b) of FIG. 34) or a method based on phase control ((c) of FIG. 34). The outputted voltage is converted into a predetermined frequency, and then is applied to the exciting coil. By using the control as described above, the electric power can be adjusted.

Figure 35:
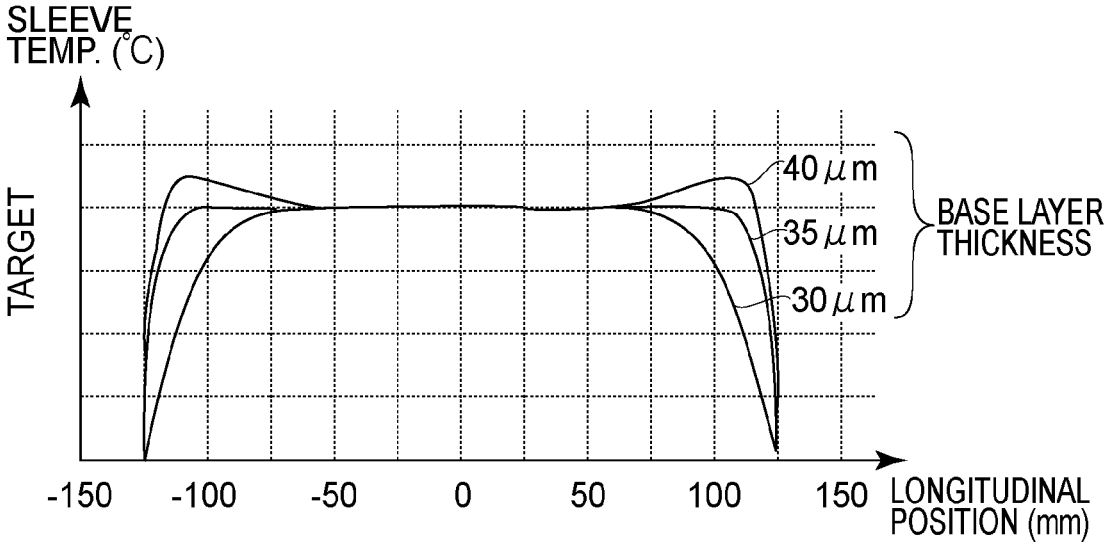
FIG. 35 is a graph showing a relationship between a fixing sleeve thickness and a longitudinal heat generation distribution.
Figure 36:
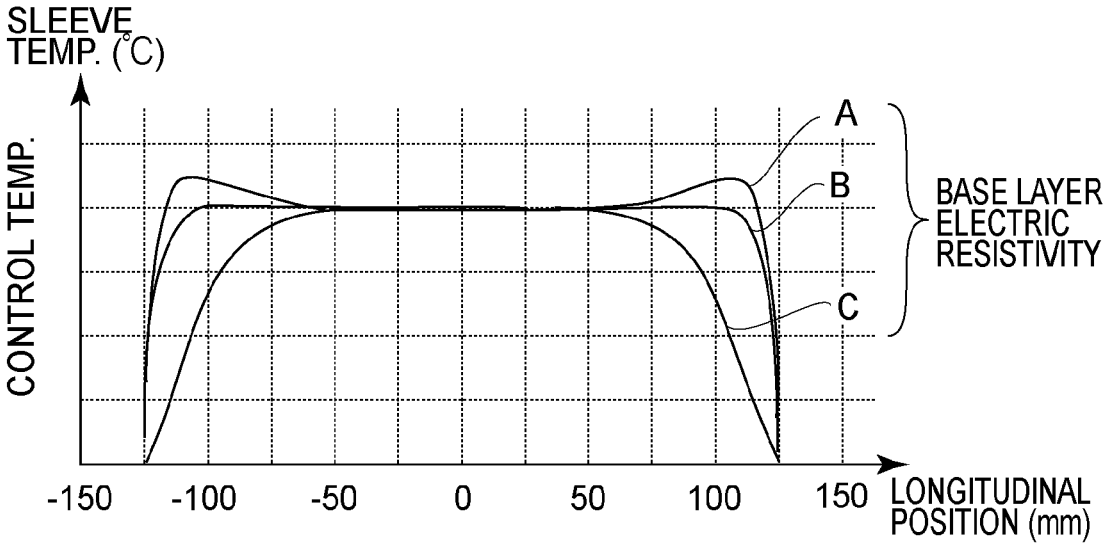
FIG. 36 is a graph showing a relationship between a fixing sleeve electric resistance and a longitudinal heat generation distribution.

Then, the temperature, the electric resistance and the temperature distribution of the base layer 1*a* of the fixing sleeve 1 will be described. FIG. 35 is a graph showing a relationship between the thickness and the temperature distribution of the base layer 1*a* of the fixing sleeve 1, and FIG. 36 is a graph showing a relationship between the electric resistance and the temperature distribution of the base layer 1*a* of the fixing sleeve 1. In this embodiment, the case where a basic frequency is set at 50 kHz will be described.

In this embodiment, first, when the winding number or the like of the coil is adjusted with respect to the longitudinal direction and the coil is used in the fixing sleeve, in the case where the basic frequency is 50 kHz, setting is made so that the longitudinal heat generation distribution becomes uniform. Specifically, the setting is made so that the longitudinal heat generation distribution becomes uniform in the case where the electric resistance B is 7.2 mΩ and the thickness of the base layer 1*a* is 35 μm. In this constitution, a result of measurement of a resistance value distribution in the case where each of the electric resistance and the base layer thickness is changed will be described.

As is understood from these figures, in the case where the basic frequency was fixed at 50 kHz, it was confirmed that the longitudinal temperature distribution largely changed when the thickness or the electric resistance of the base layer 1*a* of the fixing sleeve 1 changed.

As shown in FIG. 35, with an increasing thickness of the base layer 1*a* of the fixing sleeve 1 in the order of 30 μm, 35 μm and 40 μm, it was confirmed that the end portion temperature gradually increased. In the case of using the frequency of 50 kHz, it is understood that an ideal thickness of the base layer 1*a* for making the longitudinal temperature distribution of the fixing sleeve 1 be within a predetermined temperature difference is 35 μm.

FIG. 36 shows a longitudinal temperature distribution in the case where the electric resistance of the base layer 1*a* is each of electric resistance A=6.5 mΩ, electric resistance B=7.2 mΩ and electric resistance C=8.0 mΩ. From FIG. 36, it is understood that in the case of the electric resistance B=7.2 mΩ, the longitudinal temperature distribution of the fixing sleeve 1 can be made being within the predetermined temperature difference.

<Mechanism in which Heat Generation Distribution Varies Depending on Difference in Thickness or Electric Resistance of Fixing Sleeve Base Layer (Electroconductive Layer)>

A difference in electric resistance or base layer thickness means a difference in circumferential direction resistance of the heat generating layer 1*a* with respect to the circumferential direction. Further, from the formula (2), in the case where the circumferential direction resistance R is different, in order to provide the same synthetic impedance X for obtaining the same heat generation amount, it is understood that there is a need to adjust to the frequency.

In order words, in the case where the circumferential direction resistance R is different, a relationship (frequency dependency) of the synthetic impedance with respect to the drive frequency is different. In addition, as described above, the relationship between the synthetic impedance Xe at the end portions and the synthetic impedance Xc at the central portion and the relationship between the heat generation amount Qe at the end portions and the heat generation amount Qc at the central portion show different frequency dependencies. As a result, in order to obtain the same heat generation distribution in the case where the circumferential direction resistance R changed, there is a need to adjust the optimum frequency corresponding to the circumferential direction resistance.

Figure 37:
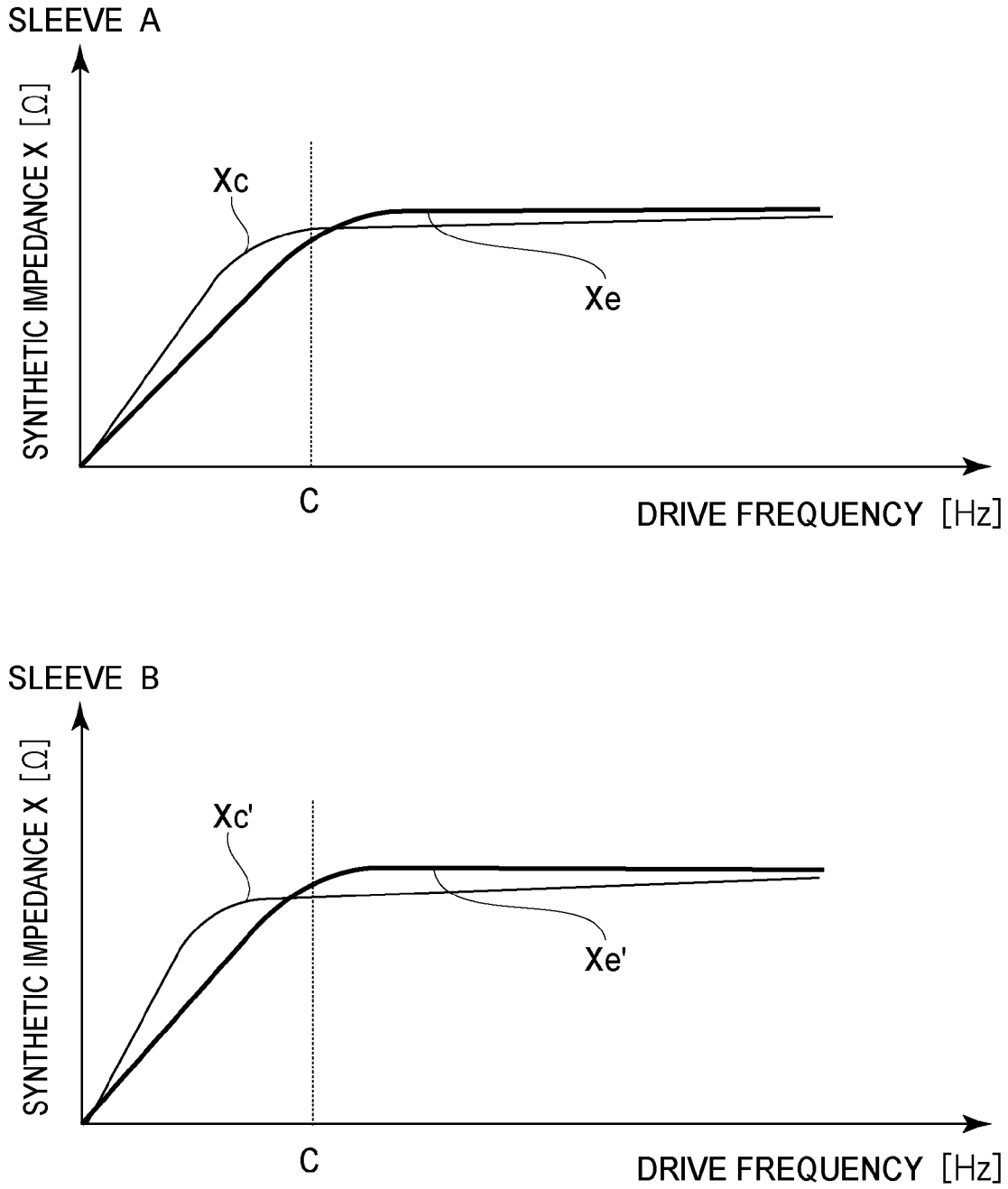
In FIG. 37, (a) and (b) are graphs showing frequency characteristics of Xe(Xe') and Xc(Xc') in different fixing sleeves A and B, respectively.
Figure 38:
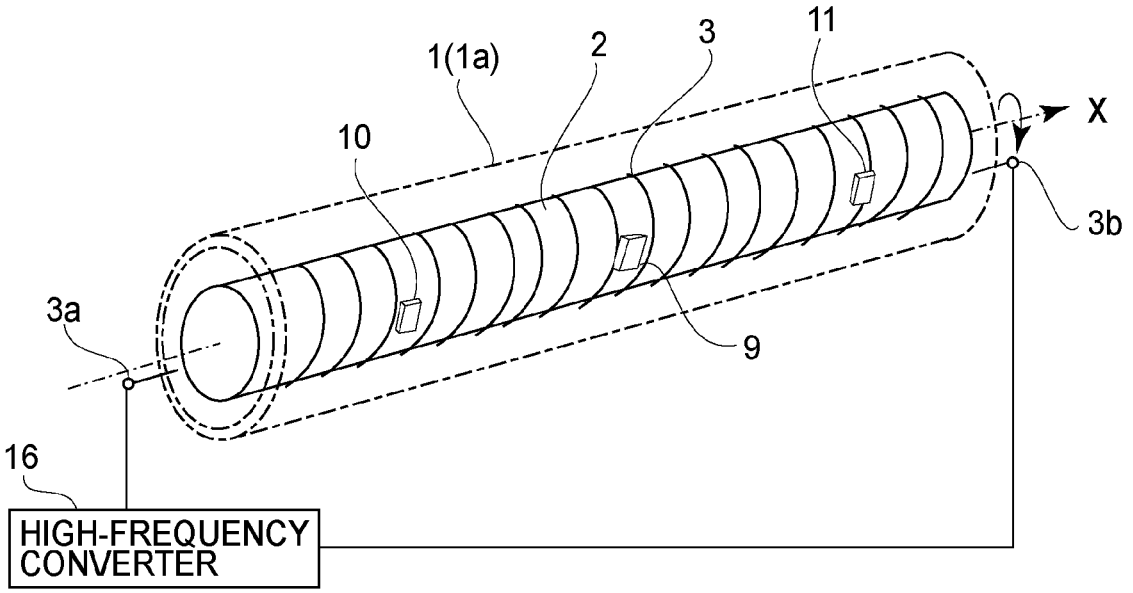
FIG. 38 is a perspective view of a principal part of a fixing device of an electromagnetic induction heating type in a conventional example.
Figure 39:
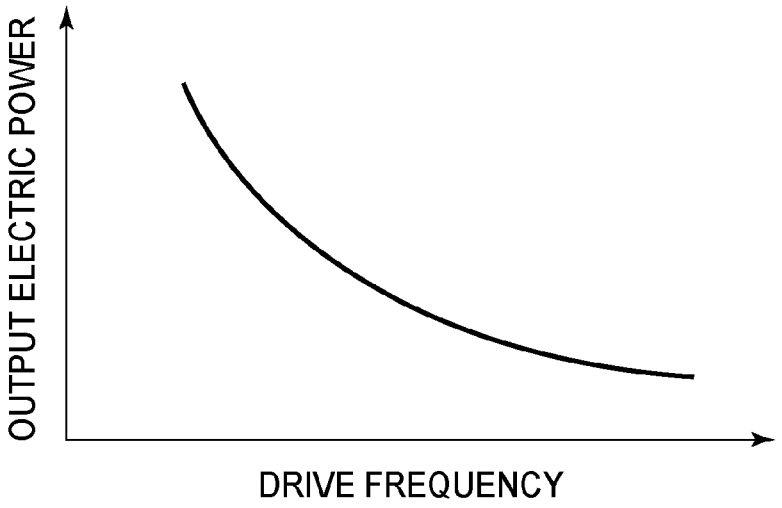
FIG. 39 is a graph showing a relationship between a drive frequency and an output voltage in a conventional example.
Figure 40:
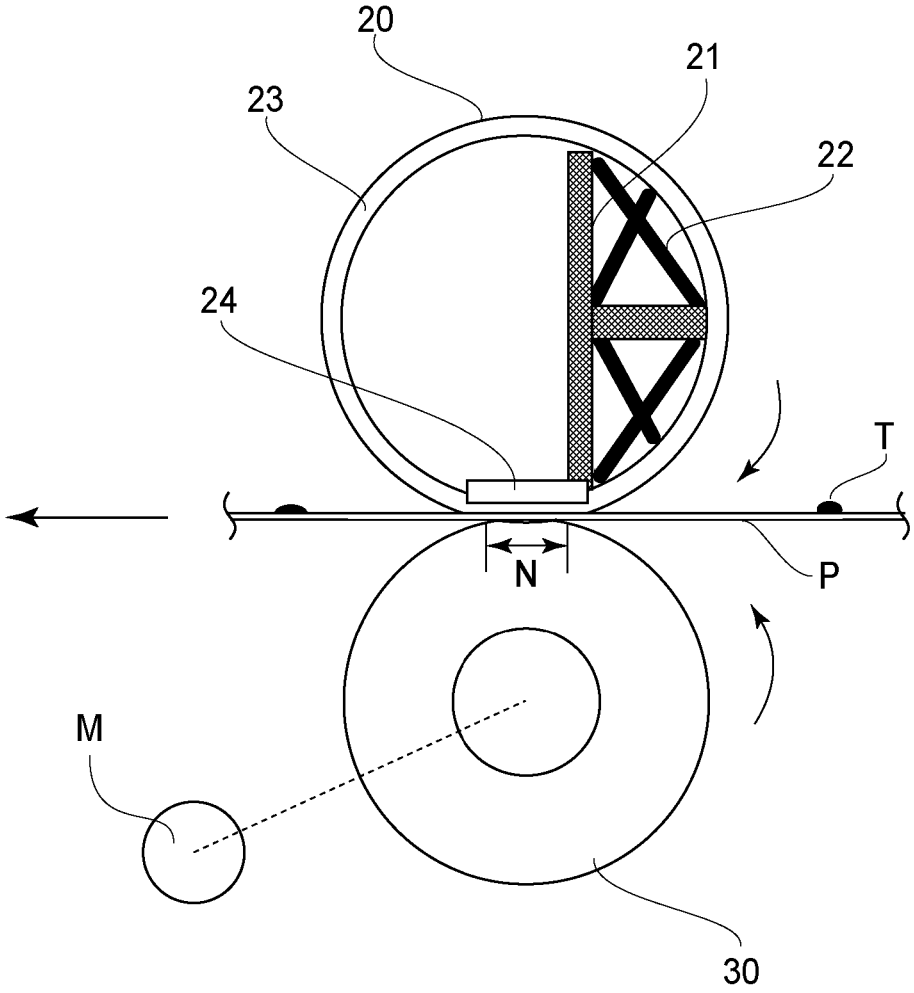
FIG. 40 is a schematic sectional view for illustrating a fixing device of an electromagnetic induction heating type in the conventional example.

FIG. 37 shows an example in which the frequency dependency of the synthetic impedance varies depending on a difference in fixing sleeve. As is understood from FIG. 37, in the cases of a fixing sleeve A and a fixing sleeve B different in circumferential direction resistance R, slopes of associated ones of the frequency dependency of the synthetic resistance are different from each other. In the case where the same drive frequency is set, an impedance ratios Xe/Xc and Xe'/Ec' at the end portions and the central portion are different from each other.

As described above, from the relationship between the drive frequency and the longitudinal temperature distribution in FIG. 13 and the relationships of the thickness and the electric resistance of the base layer 1*a* with the longitudinal temperature distribution in FIGS. 35 and 36, the frequency at which a predetermined temperature distribution can be obtained varies depending on the thickness or the electric resistance of the base layer 1*a*.

Accordingly, in order to obtain the predetermined temperature distribution in the case where the thickness of the base layer 1*a* of the fixing sleeve 1 varies or in the case where the electric resistance varies, there is a need to select an optimum frequency in each of the cases.

When the manufacturing tolerance and the difference among individuals with respect to the thickness and the electric resistance of the base layer 1*a* of the fixing sleeve 1 are taken into consideration, for the reason described above, in the case where the optimum frequency is not selected, the predetermined longitudinal temperature distribution cannot be obtained in some cases. At that time, it becomes possible to obtain the predetermined longitudinal temperature distribution by determining the drive frequency suitable for a reference thickness and a reference electric resistance of the base layer 1*a* by correcting and adjusting a reference frequency so as to provide a predetermined longitudinal temperature distribution on the basis of the detection temperature of the temperature detecting element, for example.

<Determining Method of Frequency>

In the present invention, the longitudinal temperature distribution of the fixing sleeve 1 is detected from the detection temperatures of the plurality of temperature detecting elements 9, 10, 11, and then a frequency at which the predetermined longitudinal temperature distribution can be obtained is calculated, so that control is performed.

Specifically, in the case where the reference thickness of the base layer 1*a* and the reference electric resistance are employed, the reference frequency at which the longitudinal temperature distribution detected from the temperature detecting elements 9, 10, 11 is a predetermined temperature distribution is set in advance.

In this embodiment, consider an example of the case where a fixing sleeve 1 of 35 μm in reference thickness of the base layer 1*a* and 7.2 mΩ in electric resistance B as the reference electric resistance is used and the process speed of a fixing device driving device is set at 250 mm/sec. Further, the control temperature is set at 200° C.

In this embodiment, during the above setting, the detection temperatures of the temperature detecting elements 9, 10, 11 during installation of the image forming apparatus are monitored. A detection result of the temperature detecting element disposed at the central portion and detection results of the temperature detecting elements disposed at the end portions are compared, and then the frequency at which the temperature difference is corrected in selected to obtain a predetermined temperature distribution. Further, in this embodiment, the value of the difference between the detection temperature of the temperature detecting element 9 and an average (average temperature) of the detection temperature of the temperature detecting element 10 and the detection temperature of the temperature detecting element 11 is used as a temperature difference Δ. However, the value of a difference between the temperature distribution of the temperature detecting element 9 and the temperature distribution of either one of the temperature detecting elements 10 and 11 may also be used as the temperature difference Δ.

In this embodiment, the reference frequency of the current outputted from the high-frequency converter is set at 50 kHz which is such a frequency that the longitudinal temperature distribution of the fixing sleeve 1 falls within the predetermined temperature distribution in the above-described reference constitution. Further, the correction is made by making reference to a conversion table in which a correction frequency for the temperature difference Δ is obtained in advance.

TABLE 6

| CR*1 | LV − 3 | LV − 2 | LV − 1 | LV0 | VL + 1 | LV + 2 | LV + 3 |
|---|---|---|---|---|---|---|---|
| TD*2 Δ(° C.) | −10 to −5 | −5 to −3 | −3 to −1 | ±1 | 1 to 3 | 3 to 5 | 5 to 10 |
| CF*3 (kHz) | +3 | +2 | +1 | 0 | −1 | −2 | −3 |

*1"CR" is a correction level. "LV0" is a reference value.
*2"TD" is the temperature difference.
*3"CF" is the correction frequency.

Table 6 is the correction table between the temperature difference Δ and the correction frequency for the frequency at that time. This correction table is prepared in the following manner. In a state in which the longitudinal temperature difference is substantially 0 in the case where the thickness of the base layer 1*a* of the fixing sleeve 1 is the reference thickness, the temperature difference Δ in the case where the thickness of the base layer 1*a* is changed in a range from 25 μm to 45 μm and the correction frequency at which the associated temperature difference is eliminated, i.e., the temperature difference becomes zero are obtained. Based on these values, the conversion table was prepared.

In this embodiment, it is possible to obtain a predetermined temperature distribution of the fixing sleeve 1 with respect to the longitudinal direction by setting a correction amount so that the correction frequency increases with an increasing detection temperature difference Δ and becomes 0 (no correction) in a range of 1° C. of the target temperature.

As a result, even in the case where the thickness of the base layer 1*a* of the fixing sleeve 1 changes, it becomes possible to calculate the frequency from the reference frequency in the reference constitution and the correction conversion table, and therefore it becomes possible to obtain the predetermined longitudinal temperature distribution.

As described above, by controlling the frequency, the longitudinal temperature difference of the fixing sleeve 1 can be made being a predetermined temperature difference or less. As a result, it is possible to provide a heat-fixing device and a control method which are free from a conspicuous end portion improper fixing and a non-sheet-passing portion temperature rise, which are caused in the case where the longitudinal temperature difference is large.

Further, in this embodiment, the above-described correction amount is set, but an optimum value varies depending on a device constitution, and therefore the optimum correction amount may only be required to be set as the occasion demands, so that the above-described value is merely an example.

As described above, by effecting frequency correction of the current for correcting the frequency, on the basis of the longitudinal temperature distribution obtained from the detection temperatures of the temperature detecting elements, by the controller 40, the predetermined temperature distribution can be obtained.

At the controller 40, a frequency after correction is determined by the frequency correction control for correcting the frequency on the basis of the longitudinal temperature distribution of the fixing sleeve 1 obtained from the detection temperatures of the temperature detecting elements. Then, the determined value (frequency) is stored in a non-volatile memory (storing portion 433), and may also be used as a new frequency during the start of subsequent image formation and later.

The above-described constitution of the heat-fixing device 113 in Embodiment 1 is summarized as follows.

1) The fixing device includes the cylindrical rotatable member (fixing sleeve 1) having the electroconductive layer 1*a*. The fixing device includes the elongated magnetic core material (magnetic core) 2 which is inserted into the hollow portion of the rotatable member 1 and which extends in the generatrix direction of the rotatable member 1. The magnetic core material 2 includes the exciting coil 3 which does not form a loop outside the rotatable member 1 and which is wound around the magnetic core material 2 directly or via another member with respect to the direction perpendicular to the generatrix direction. The heat-fixing device fixes the image T on the recording material P by passing the AC control through the exciting coil 3 to cause the electroconductive layer 1*a* to generate heat through the electromagnetic induction heating.

The fixing device includes a frequency setting portion 45 for setting the frequency of the AC current. The fixing device includes temperature distribution obtaining portions 9 to 11 for obtaining the temperature distribution of the rotatable member 1. The fixing device includes the controller 43 for effecting control so that the longitudinal temperature distribution of the rotatable member 1 is the predetermined distribution by adjusting the frequency through the frequency setting portion 45 on the basis of obtaining results of the temperature distribution obtaining portions 9 to 11.

2) The value obtained by the frequency setting portion 45 is stored in the storing portion 433, and the stored value is used as the frequency during subsequent image formation and later.

Embodiment 2

In this embodiment, similarly as in Embodiment 1, the temperatures are detected by the temperature detecting elements. Then, in the case where there is a temperature difference exceeding a predetermined temperature difference, such a frequency that the temperature difference Δ is eliminated or falls within a predetermined temperature difference (predetermined range) is obtained, and then the obtained value is used as the frequency.

In this embodiment, the detection temperatures of the temperature detecting elements 9, 10, 11 during installation of the image forming apparatus are monitored. Then, for example, in the case where the detection temperatures of the temperature detecting elements 10, 11 disposed at the end portions are lower than the set temperature of the temperature detecting element 9 disposed at the central portion, an operation in which the frequency gradually increases relative to the reference frequency is started. As a result, the temperature difference Δ gradually decreases, and at a certain frequency, the temperature difference Δ is eliminated or falls within the predetermined temperature difference (range).

In this way, the frequency is adjusted until the longitudinal temperature difference Δ falls within the predetermined range, and the frequency falling within a target range is used as a new frequency, so that the frequency capable of obtaining the predetermined longitudinal temperature distribution can be obtained.

Similarly, in the case where the detection temperatures of the temperature detecting elements 10, 11 disposed at the end portions are higher than the set temperature of the temperature detecting element 9 disposed at the central portion, there is a need to use the frequency lower than the reference frequency. For that reason, the frequency is gradually lowered, and is similarly adjusted until the temperature difference Δ falls within the predetermined temperature difference (range), and then the frequency after the adjustment is used as a frequency after the correction, so that the predetermined longitudinal temperature distribution can be obtained.

In control in this embodiment, a frequency providing the predetermined temperature distribution is determined while detecting the temperature difference Δ and changing the frequency. For that reason, there is no need to prepare a conversions table with respect to the difference in advance, and therefore it becomes possible to effect optimum frequency control more simply.

Also in this case, similarly as in Embodiment 1, the frequency obtained by the control in this embodiment is stored in the non-volatile memory (storing portion 433), and may also be used as a new drive frequency during the start of a subsequent image formation and later.

The above-described control constitution of the heat-fixing device in Embodiment 2 is summarized as follows.

1) The fixing device includes the frequency setting portion 45 for setting the AC current. The fixing device includes at least two temperature detecting elements 9 to 11 for detecting the temperatures at portions different from each other with respect to the longitudinal direction of the rotatable member (fixing sleeve) 1. The fixing device includes the controller 43 for adjusting the longitudinal temperature distribution of the rotatable member 1 by adjusting the frequency through the frequency setting portion 45 so that the temperature difference between the temperatures of the rotatable member 1 detected by the above-described at least two temperature detecting elements 9 to 11 falls within the predetermined temperature difference range.

2) The value of the frequency obtained by the frequency setting portion is stored, and then the stored value is used as the frequency during subsequent image formation and later.

Embodiment 3

In this embodiment, during manufacturing of the fixing device, the thickness of the base layer 1*a*, the electric resistance or the temperature distribution is measured, and then the drive frequency is determined in advance. In this embodiment, a rotatable member temperature distribution adjusting method during the manufacturing of the fixing device is described.

The thickness of the base layer 1*a* of the fixing sleeve 1 and the electric resistance are measured in advance, and then on the basis of a result thereof, the drive frequency of the coil is determined so that the longitudinal temperature distribution is the predetermined temperature distribution.

Specifically, during the manufacturing of the fixing device (image forming apparatus), the thickness of the base layer 1*a* of the fixing sleeve 1 and the electric resistance are actually measured. Such a drive frequency of the exciting coil that a longitudinal temperature distribution estimated from the measured values can be the predetermined temperature distribution is determined from a correction table or conversion formula or the like in which a relationship among the thickness of the base layer 1*a*, the electric resistance and the frequency is obtained in advance. The drive frequency is stored in the non-volatile memory (storing portion 433) provided in the apparatus main assembly of the image forming apparatus or in the fixing device, and then during a subsequent operation of the apparatus main assembly, control using the thus-determined frequency is carried out.

Or, in a manufacturing process of the fixing device, as in Embodiment 1, such a frequency that the detection temperature difference between the temperature detecting elements falls within the predetermined temperature difference is obtained from the correction table, the conversion formula, or the like. The obtained value may also be stored as the drive frequency in the non-volatile memory provided in the apparatus main assembly or in the fixing device.

Or, in the fixing device manufacturing process, as in Embodiment 2, such a frequency that the temperature difference is eliminated or falls within the predetermined temperature difference is obtained by gradually increasing and/or decreasing the frequency, and then the thus-obtained value is used as the drive frequency. Similarly, the frequency is stored in the non-volatile memory provided in the apparatus main assembly or in the fixing device, and then during a subsequent operation of the main assembly, control using the thus-determined frequency may also be executed.

Or, in the fixing device manufacturing process, such a frequency that the longitudinal temperature distribution of the fixing sleeve is the predetermined temperature distribution is obtained using a temperature detecting means (unshown) provided outside the develop. A result thereof is stored in the non-volatile memory or the like provided in the apparatus main assembly or in the fixing device, and then may also be used as the drive frequency during image formation.

By using these methods, the frequency is determined in advance during the manufacturing of the fixing device, and then is stored in the non-volatile memory or the like, so that there is no need to perform a control sequence for determining the frequency in a final product itself.

The control constitution of the heat-fixing device in Embodiment 3 is summarized as follows.

1). The fixing device includes the frequency setting portion 45 for setting the frequency of the AC current. The fixing device includes the controller 43 for determining the frequency set by the frequency setting portion 45 so that the longitudinal temperature distribution of the rotatable member (fixing sleeve) 1 is the predetermined temperature distribution, on the basis of a result of the thickness obtained by measuring the thickness of the electroconductive layer 1*a* in advance.

2). The fixing device includes the frequency setting portion 45 for setting the frequency of the AC current. The fixing device includes the controller 43 for determining the frequency set by the frequency setting portion 45 so that the longitudinal temperature distribution of the rotatable member (fixing sleeve) 1 is the predetermined temperature distribution, on the basis of a result of the electric resistance obtained by measuring the electric resistance of the electroconductive layer 1*a* in advance.

3). The fixing device includes the frequency setting portion 45 for setting the frequency of the AC current. The fixing device includes the controller 43 for determining the frequency set by the frequency setting portion 45 so that the longitudinal temperature distribution of the rotatable member (fixing sleeve) 1 is the predetermined temperature distribution, on the basis of the temperature distribution information obtained by the external temperature detecting portion in advance.

Here, the heat-fixing device may include, other than the fixing device for fixing the unfixed toner image as the fixed image, a device for improving a glossiness of the image by a re-heating and re-pressing the toner image which is temporarily fixed on the recording material or which is once heat-fixed on the recording material.

The cylindrical rotatable member 1 including the electroconductive layer 1*a* can also be formed in a flexible endless belt which is extended and stretched around a plurality of stretching members and which is rotationally driven. Further, the cylindrical rotatable member 1 including the electroconductive layer 1*a* can also be formed in a hard hollow roller or pipe.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-148610 filed on Jul. 22, 2014, which is hereby incorporated by reference herein in its entirety.

What is claimed is:

1. A fixing device for fixing an image on a recording material, comprising:

a rotatable member including an electroconductive layer;

a helical coil provided inside said rotatable member, said helical coil having a helical axis direction along a generatrix direction of said rotatable member;

a magnetic member extending in a helically shaped portion formed by said coil, wherein said magnetic member does not form a loop outside the electroconductive layer;

a frequency setting portion configured to set the frequency of an AC current caused to flow through said coil; and a temperature detecting portion configured to detect the temperature of said rotatable member, said temperature detecting portion including a first temperature detecting member configured to detect the temperature of said rotatable member at a central portion with respect to the generatrix direction and a second temperature detecting member configured to detect the temperature of said rotatable member at an end portion with respect to the generatrix direction, wherein the electroconductive layer generates heat through electromagnetic induction heating by the magnetic flux resulting from the AC current, and the image is fixed on the recording material by the heat of said rotatable member, and wherein said frequency setting portion sets the frequency depending on a value of a difference between a detection temperature of said first temperature detecting member and a detection temperature of said second temperature detecting member.

2. A fixing device according to claim 1, wherein when a value obtained by subtracting the detection temperature of said first temperature detecting member from the detection temperature of said second temperature detecting member is larger than a predetermined value, said frequency setting portion sets the frequency so that the value is smaller than that when the value is smaller than the predetermined value.

3. A fixing device according to claim 1, wherein when a value obtained by subtracting the detection temperature of said second temperature detecting member from the detection temperature of said second temperature detecting member is larger than a predetermined value, said frequency setting portion sets the frequency so that the value is larger than that when the value is smaller than the predetermined value.

4. A fixing device for fixing an image on a recording material, comprising:

a rotatable member including an electroconductive layer;

a helical coil provided inside said rotatable member, said helical coil having a helical axis direction along a generatrix direction of said rotatable member;

a magnetic member extending in a helically shaped portion formed by said coil, wherein said magnetic member does not form a loop outside the electroconductive layer;

a frequency setting portion configured to set the frequency of an AC current caused to flow through said coil; and a temperature detecting portion configured to detect the temperature of said rotatable member, said temperature detecting portion including a first temperature detecting member configured to detect the temperature of said rotatable member at a central portion with respect to the generatrix direction and a second temperature detecting member configured to detect the temperature of said rotatable member at one end portion with respect to the generatrix direction, and a third temperature detecting member configured to detect the temperature of said rotatable member at the other end portion with respect to the generatrix direction, wherein the electroconductive layer generates heat through electromagnetic induction heating by the magnetic flux resulting from the AC current, and the image is fixed on the recording material by the heat of said rotatable member, and wherein said frequency setting portion sets the frequency depending on a value of a difference between a detection temperature of said first temperature detecting member and an average temperature between a detection temperature of said second temperature detecting member and a detection temperature of said third temperature detecting member.

5. A fixing device for fixing an image on a recording material, comprising:

a rotatable member including an electroconductive layer;

a helical coil provided inside said rotatable member, said helical coil having a helical axis direction along a generatrix direction of said rotatable member;

a magnetic member extending in to a helically shaped portion formed by said coil, wherein said magnetic member does not form a loop outside the electroconductive layer;

a frequency setting portion configured to set the frequency of an AC current caused to flow through said coil; and a temperature distribution detecting portion configured to detect the temperature of said rotatable member with respect to a longitudinal direction of said rotatable member, wherein the electroconductive layer generates heat through electromagnetic induction heating by the magnetic flux resulting from the AC current, and the image is fixed on the recording material by the heat of said rotatable member, and wherein said frequency setting portion sets the frequency depending on the temperature distribution detected by said temperature distribution detecting member.

6. A temperature distribution adjusting method of a fixing portion provided in an image forming apparatus, wherein the fixing portion includes a rotatable member including an electroconductive layer, a helical coil provided inside the said rotatable member having a helical axis direction along a generatrix direction of the rotatable member, and a non-endless magnetic member provided inside a helically shaped portion formed by the coil, said temperature distribution adjusting method comprising the steps of:

passing an AC current through the coil to cause the electroconductive layer to generate heat through electromagnetic induction heating;

detecting the temperature of the rotatable member at each of a central portion and an end portion with respect to a generatrix direction of the rotatable member; and adjusting the frequency of the AC current so that when a value of a difference between the temperature at the central portion and the temperature at the end portion is out of a predetermined range, the value of the difference is made to fall within the predetermined range.

7. A temperature distribution adjusting method according to claim 6, wherein the determined frequency is stored in a storing portion provided in the image forming apparatus.

8. A temperature distribution adjusting method of a fixing portion provided in an image forming apparatus, wherein the fixing portion includes a rotatable member including an electroconductive layer, a helical coil provided inside the rotatable member having a helical axis direction along a generatrix direction of the rotatable member, and a non-endless magnetic member provided inside a helically shaped portion formed by the coil, said temperature distribution adjusting method comprising the steps of:

passing an AC current through the coil to cause the electroconductive layer to generate heat through electromagnetic induction heating;

detecting a temperature distribution of the rotatable member with respect to a generatrix direction of the rotatable member; and adjusting the frequency of the AC current so that when the temperature distribution is out of a predetermined range, the value of the temperature distribution is made to fall within the predetermined range.

9. A temperature distribution adjusting method according to claim 8, wherein the determined frequency is stored in a storing portion provided in the image forming apparatus.

* * * * *